US010685637B2

(12) United States Patent
Kotegawa et al.

(10) Patent No.: US 10,685,637 B2
(45) Date of Patent: Jun. 16, 2020

(54) NOISE MASKING DEVICE, VEHICLE AND NOISE MASKING METHOD

(71) Applicant: PANASONIC INTELLECTUAL PROPERTY MANAGEMENT CO., LTD., Osaka (JP)

(72) Inventors: Kazuhisa Kotegawa, Osaka (JP); Kiyohisa Higashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/178,170

(22) Filed: Nov. 1, 2018

(65) Prior Publication Data

US 2019/0130887 A1 May 2, 2019

(30) Foreign Application Priority Data

Nov. 2, 2017 (JP) ..... 2017-213227

(51) Int. Cl.
*G10K 11/175* (2006.01)
*H04R 3/00* (2006.01)
*H04R 3/12* (2006.01)

(52) U.S. Cl.
CPC ..... *G10K 11/175* (2013.01); *H04R 3/002* (2013.01); *H04R 3/12* (2013.01); *H04R 2499/13* (2013.01)

(58) Field of Classification Search
CPC ..... G10K 11/175; H04R 3/002; H04R 3/12; H04R 2499/13
USPC ..... 381/73.1
See application file for complete search history.

(56) References Cited

U.S. PATENT DOCUMENTS

2009/0028353 A1* 1/2009 Kobayashi ..... A63G 31/16 381/61
2010/0158263 A1* 6/2010 Katzer ..... G10K 11/175 381/73.1

FOREIGN PATENT DOCUMENTS

JP 03-093251 9/1991
JP 2012-201241 10/2012

* cited by examiner

*Primary Examiner* — Vivian C Chin
*Assistant Examiner* — Douglas J Suthers
(74) *Attorney, Agent, or Firm* — Greenblum & Bernstein, P.L.C.

(57) ABSTRACT

A noise masking device includes: an acquisition unit that acquires (i) frequency information indicating a frequency of a noise in a vehicle or frequency-correlated information correlated to the frequency and (ii) vehicle information relating to a characteristic of the noise; a signal source that generates a masker signal for outputting a masker sound that masks the noise in the vehicle; a pitch-shifting unit that pitch-shifts the masker signal according to the frequency information or the frequency-correlated information acquired by the acquisition unit to generate a pitch-shifted masker signal; an adjustment unit that performs, on the pitch-shifted masker signal, an adjustment according to the vehicle information acquired by the acquisition unit to generate an adjusted masker signal; and an output unit that outputs the adjusted masker signal as the masker sound.

18 Claims, 18 Drawing Sheets

NOISE MASKING DEVICE, VEHICLE AND NOISE MASKING METHOD

CROSS REFERENCE TO RELATED APPLICATION

The present application claims the benefit of Japanese Patent Application No. 2017-213227 filed Nov. 2, 2017. The entire disclosure of the above-identified application, including the specification, drawings and claims is incorporated herein by reference in its entirety.

FIELD

The present disclosure relates to a noise masking device that reduces unpleasantness of a noise by outputting a masker sound that masks the noise, a vehicle including the noise masking device, and a sound masking method.

BACKGROUND

There are known techniques based on the masking theory that reduce the unpleasantness of a noise felt by a user. For example, PTL 1 discloses a noise eliminating device that makes a noise, such as a sound of gears meshing with each other, less perceivable to the ears of a user by outputting a white noise having slightly smaller volume than the noise.

PTL 2 discloses an active vibration noise suppressing device that actively suppresses a noise produced by a vehicle by outputting a control sound that is in opposite phase to the noise.

CITATION LIST

Patent Literature

[PTL 1] Japanese Unexamined Patent Application Publication Number H03-093251

[PTL 2] Japanese Unexamined Patent Application Publication Number 2012-201241

SUMMARY

Technical Problem

However, the devices according to PTL 1 and PTL2 can be improved upon.

In view of this, the present disclosure provides a noise masking device, a vehicle including the noise masking device, and a noise masking method which are capable of improving upon the above related art.

Solution to Problem

A noise masking device according to an aspect of the present disclosure includes: an acquisition unit that acquires (i) frequency information indicating a frequency of a noise in a vehicle or frequency-correlated information correlated to the frequency and (ii) vehicle information relating to a characteristic of the noise; a signal source that generates a masker signal for outputting a masker sound that masks the noise in the vehicle; a pitch-shifting unit that pitch-shifts the masker signal according to the frequency information or the frequency-correlated information acquired by the acquisition unit to generate a pitch-shifted masker signal; an adjustment unit that performs, on the pitch-shifted masker signal, an adjustment according to the vehicle information acquired by the acquisition unit to generate an adjusted masker signal; and an output unit that outputs the adjusted masker signal as the masker sound.

A noise masking device according to an aspect of the present disclosure includes: an acquisition unit that acquires (i) frequency information indicating a frequency of a noise in a vehicle or frequency-correlated information correlated to the frequency and (ii) vehicle information relating to a characteristic of the noise; a signal source that generates a masker signal for outputting a masker sound that masks the noise in the vehicle; a pitch-shifting unit that pitch-shifts the masker signal according to the frequency information or the frequency-correlated information acquired by the acquisition unit to generate a pitch-shifted masker signal; an adjustment unit that calculates a time-varying value in the vehicle information acquired by the acquisition unit, and performs an adjustment according to the time-varying value on the pitch-shifted masker signal to generate an adjusted masker signal; and an output unit that outputs the adjusted masker signal as the masker sound.

It should be noted that these general and specific aspects may be realized as a system, a method, an integrated circuit, a computer program, or a computer-readable recording medium such as a CD-ROM, and may be realized by any combination of a system, method, computer program, and recording method.

Advantageous Effects

A noise masking device according to an aspect of the present disclosure is capable of improving upon the above related art.

BRIEF DESCRIPTION OF DRAWINGS

These and other objects, advantages and features of the present disclosure will become apparent from the following description thereof taken in conjunction with the accompanying drawings that illustrate a specific embodiment of the present disclosure.

Figure 1:
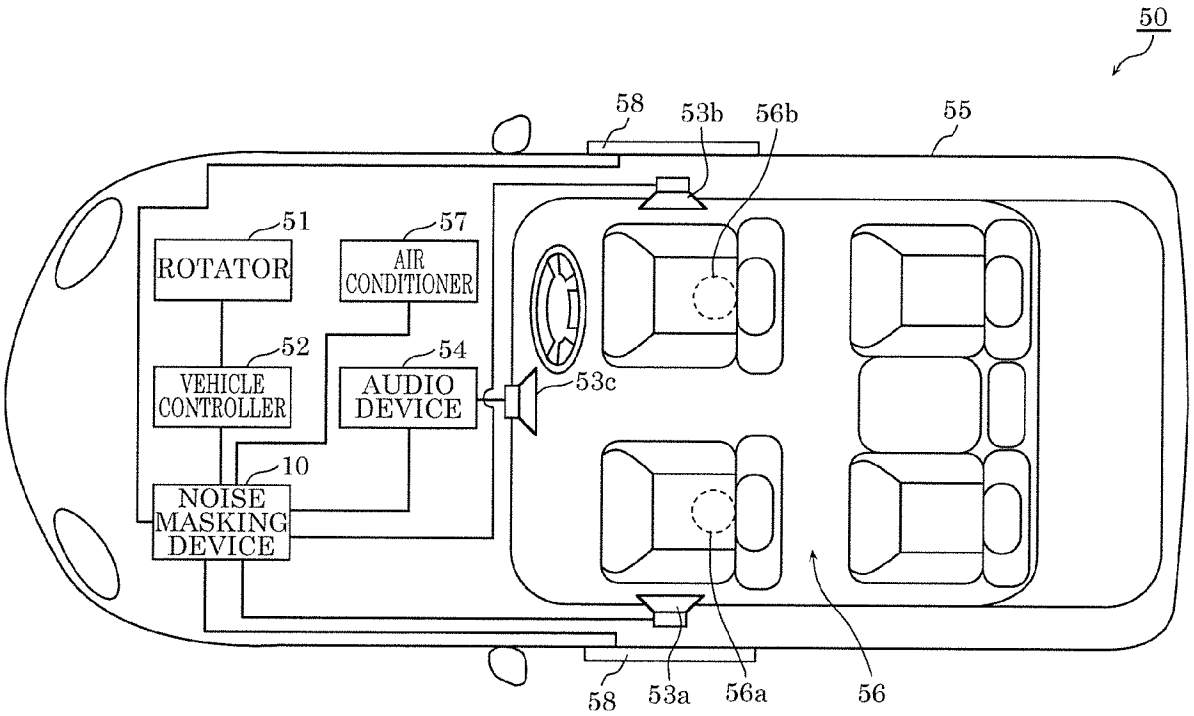
FIG. 1 is a schematic diagram illustrating a vehicle including a noise masking device according to an embodiment.

DESCRIPTION OF EMBODIMENT (Underlying Knowledge forming the Basis of the Present Disclosure)

When the volume of a masker sound to mask a noise (maskee) is smaller than the volume of the noise, the effect of masking the noise can be insufficient. On the other hand, when the volume of the masker sound is significantly larger than the volume of the noise, the masker sound itself can become unpleasant for a user. Thus, with a noise masking device based on the masking theory, characteristics (such as volume) of the masker sound are important. More specifically, it is important to produce a masker sound in consideration of a spectral characteristic and the volume at each frequency.

However, with the technique disclosed in PTL 1, when the masker sound is simply output from an output unit such as a speaker, it is difficult to effectively mask the noise with the masker sound at the timing when the noise is produced, and the problem described above cannot be solved.

With the technique disclosed in PTL 2, while a noise in a low frequency band up to 300 Hz is effectively reduced, a noise in a frequency band greater than or equal to 300 Hz is less effectively reduced. Thus, it is difficult to reduce a noise in a frequency band greater than or equal to 300 Hz.

The present disclosure provides a noise masking device capable of effectively masking a noise in a predetermined frequency band at the timing when the noise occurs, for example.

A noise masking device according to an aspect of the present disclosure includes: an acquisition unit that acquires (i) frequency information indicating a frequency of a noise in a vehicle and (ii) vehicle information relating to a characteristic of the noise; a signal source that generates a masker signal for outputting a masker sound that masks the noise in the vehicle; a pitch-shifting unit that pitch-shifts the masker signal according to the frequency information acquired by the acquisition unit to generate a pitch-shifted masker signal; an adjustment unit that performs, on the pitch-shifted masker signal, an adjustment according to the vehicle information acquired by the acquisition unit to generate an adjusted masker signal; and an output unit that outputs the adjusted masker signal as the masker sound.

Accordingly, the noise masking device pitch-shifts the masker signal generated by the signal source according to the acquired frequency information to generate a pitch-shifted masker signal, performs, on the pitch-shifted masker signal, an adjustment according to the acquired vehicle information to generate an adjusted masker signal, and outputs the adjusted masker signal as the masker sound. Therefore, the noise masking device can effectively mask a noise in a predetermined frequency band at the timing when the noise occurs.

A noise masking device according to an aspect of the present disclosure includes: an acquisition unit that acquires (i) frequency-correlated information correlated to a frequency of a noise in a vehicle and (ii) vehicle information relating to a characteristic of the noise; a signal source that generates a masker signal for outputting a masker sound that masks the noise in the vehicle; a pitch-shifting unit that pitch-shifts the masker signal according to the frequency-correlated information acquired by the acquisition unit to generate a pitch-shifted masker signal; an adjustment unit that performs, on the pitch-shifted masker signal, an adjustment according to the vehicle information acquired by the acquisition unit to generate an adjusted masker signal; and an output unit that outputs the adjusted masker signal as the masker sound.

Accordingly, the noise masking device pitch-shifts the masker signal generated by the signal source according to the acquired frequency-correlated information to generate a pitch-shifted masker signal, performs, on the pitch-shifted masker signal, an adjustment according to the acquired vehicle information to generate an adjusted masker signal, and outputs the adjusted masker signal as the masker sound. Therefore, the noise masking device can effectively mask a noise in a predetermined frequency band at the timing when the noise occurs.

A noise masking device according to an aspect of the present disclosure includes: an acquisition unit that acquires (i) frequency information indicating a frequency of a noise in a vehicle and (ii) vehicle information relating to a characteristic of the noise; a signal source that generates a masker signal for outputting a masker sound that masks the noise in the vehicle; a pitch-shifting unit that pitch-shifts the masker signal according to the frequency information acquired by the acquisition unit to generate a pitch-shifted masker signal; an adjustment unit that calculates a time-varying value in the vehicle information acquired by the acquisition unit, and performs an adjustment according to the time-varying value on the pitch-shifted masker signal to generate an adjusted masker signal; and an output unit that outputs the adjusted masker signal as the masker sound.

Accordingly, the noise masking device pitch-shifts the masker signal generated by the signal source according to the acquired frequency information to generate a pitch-shifted masker signal, performs, on the pitch-shifted masker signal, an adjustment according to the acquired time-varying value in the vehicle information to generate an adjusted masker signal, and outputs the adjusted masker signal as the masker sound. Therefore, the noise masking device can effectively mask a noise in a predetermined frequency band at the timing when the noise occurs.

A noise masking device according to an aspect of the present disclosure includes: an acquisition unit that acquires (i) frequency-correlated information correlated to a frequency of a noise in a vehicle and (ii) vehicle information relating to a characteristic of the noise; a signal source that generates a masker signal for outputting a masker sound that masks the noise in the vehicle; a pitch-shifting unit that pitch-shifts the masker signal according to the frequency-correlated information acquired by the acquisition unit to generate a pitch-shifted masker signal; an adjustment unit that calculates a time-varying value in the vehicle information acquired by the acquisition unit, and performs an adjustment according to the time-varying value on the pitch-shifted masker signal to generate an adjusted masker signal; and an output unit that outputs the adjusted masker signal as the masker sound.

Accordingly, the noise masking device pitch-shifts the masker signal generated by the signal source according to the acquired frequency-correlated information to generate a pitch-shifted masker signal, performs, on the pitch-shifted masker signal, an adjustment according to the acquired time-varying value in the vehicle information to generate an adjusted masker signal, and outputs the adjusted masker signal as the masker sound. Therefore, the noise masking device can effectively mask a noise in a predetermined frequency band at the timing when the noise occurs.

A noise masking device according to an aspect of the present disclosure includes: an acquisition unit that acquires (i) frequency information indicating a frequency of a noise in a vehicle and (ii) vehicle information relating to a characteristic of the noise; a signal source that generates a masker signal for outputting a masker sound that masks the noise in the vehicle; a pitch-shifting unit that pitch-shifts the masker signal according to the frequency information acquired by the acquisition unit to generate a pitch-shifted masker signal; an adjustment unit that performs at least one of a first adjustment of performing, on the pitch-shifted masker signal, an adjustment according to the vehicle information and a second adjustment of calculating a time-varying value in the vehicle information acquired by the acquisition unit, and performing an adjustment according to the time-varying value on the pitch-shifted masker signal to generate an adjusted masker signal; and an output unit that outputs the adjusted masker signal as the masker sound.

Accordingly, the noise masking device pitch-shifts the masker signal generated by the signal source according to the acquired frequency information to generate a pitch-shifted masker signal, performs, on the pitch-shifted masker signal, an adjustment according to the acquired vehicle information and/or the time-varying value in the vehicle information to generate an adjusted masker signal, and outputs the adjusted masker signal as the masker sound. Therefore, the noise masking device can effectively mask a noise in a predetermined frequency band at the timing when the noise occurs.

A noise masking device according to an aspect of the present disclosure includes: an acquisition unit that acquires (i) frequency-correlated information correlated to a frequency of a noise in a vehicle and (ii) vehicle information relating to a characteristic of the noise; a signal source that generates a masker signal for outputting a masker sound that masks the noise in the vehicle; a pitch-shifting unit that pitch-shifts the masker signal according to the frequency-correlated information acquired by the acquisition unit to generate a pitch-shifted masker signal; an adjustment unit that performs, on the pitch-shifted masker signal, at least one of a first adjustment of performing an adjustment according to the vehicle information relating to the characteristic of the noise and a second adjustment of calculating a time-varying value in the vehicle information acquired by the acquisition unit, and performing an adjustment according to the time-varying value, to generate an adjusted masker signal; and an output unit that outputs the adjusted masker signal as the masker sound.

Accordingly, the noise masking device pitch-shifts the masker signal generated by the signal source according to the acquired frequency-correlated information to generate a pitch-shifted masker signal, performs, on the pitch-shifted masker signal, an adjustment according to the acquired vehicle information and/or the time-varying value in the vehicle information to generate an adjusted masker signal, and outputs the adjusted masker signal as the masker sound. Therefore, the noise masking device can effectively mask a noise in a predetermined frequency band at the timing when the noise occurs.

Furthermore, for example, the vehicle may include a motor that drives the vehicle, and the adjustment unit may perform, on the pitch-shifted masker signal, an adjustment according to information on the motor included in the vehicle information acquired by the acquisition unit.

Accordingly, the noise masking device performs, on the pitch-shifted masker signal, an adjustment according to the acquired information on the motor of the vehicle to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle may includes an engine that drives the vehicle, and the adjustment unit may perform, on the pitch-shifted masker signal, an adjustment according to information on the engine included in the vehicle information acquired by the acquisition unit.

Accordingly, the noise masking device performs, on the pitch-shifted masker signal, an adjustment according to the acquired information on the engine of the vehicle to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle may includes an engine and a motor that drive the vehicle, and the adjustment unit may perform, on the pitch-shifted masker signal, an adjustment according to information on the engine and/or information on the motor included in the vehicle information acquired by the acquisition unit.

Accordingly, the noise masking device performs, on the pitch-shifted masker signal, an adjustment according to the acquired information on the engine and/or information on the motor of the vehicle to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the information on the motor may be a number of rotations of the motor.

Accordingly, the noise masking device performs, on the pitch-shifted masker signal, an adjustment according to the acquired number of rotations of the motor to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the information on the motor may be a motor current value.

Accordingly, the noise masking device performs, on the pitch-shifted masker signal, an adjustment according to the acquired motor current value to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the information on the engine may be a number of rotations of the engine.

Accordingly, the noise masking device performs, on the pitch-shifted masker signal, an adjustment according to the acquired number of rotations of the engine to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the information on the engine may be an engine load.

Accordingly, the noise masking device performs, on the pitch-shifted masker signal, an adjustment according to the acquired engine load to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle information may be a vehicle speed.

Accordingly, the noise masking device performs, on the pitch-shifted masker signal, an adjustment according to the acquired vehicle speed to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle information may be an accelerator pedal depression amount.

Accordingly, the noise masking device performs, on the pitch-shifted masker signal, an adjustment according to the acquired accelerator pedal depression amount to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle information may be a brake oil pressure.

Accordingly, the noise masking device performs, on the pitch-shifted masker signal, an adjustment according to the acquired brake oil pressure to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle information may be a number of rotations of a drive shaft.

Accordingly, the noise masking device performs, on the pitch-shifted masker signal, an adjustment according to the acquired number of rotations of the drive shaft to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the vehicle information may be a torque.

Accordingly, the noise masking device performs, on the pitch-shifted masker signal, an adjustment according to the acquired torque to generate an adjusted masker signal, and outputs the adjusted masker signal as the masker sound from the output unit. Therefore, the noise masking device can effectively mask a noise in a predetermined frequency band at the timing when the noise occurs.

Furthermore, for example, the adjustment unit may adjust the pitch-shifted masker signal so that a volume level of the adjusted masker signal changes according to the vehicle information relating to the characteristic of the noise and/or a time-varying value in the vehicle information.

Accordingly, in response to the vehicle information and/or the time-varying value in the vehicle information indicating that a noise in a predetermined frequency band is likely to occur, the noise masking device adjusts the pitch-shifted masker signal so that the volume level of the adjusted masker sound becomes greater than a predetermined level above which the masker sound can mask the noise. Therefore, the noise masking device can effectively mask the noise in the predetermined frequency band at the timing when the noise occurs.

Furthermore, for example, the adjustment unit may adjust the pitch-shifted masker signal so that a volume level of the adjusted masker signal changes over a transition time according to the vehicle information relating to the characteristic of the noise and/or a time-varying value in the vehicle information.

Accordingly, the boundary of the masker signal, which is caused by repeated consecutive use of the masker signal, is made less perceivable to the occupants. In addition, there is the advantageous effect that, in adjustment of the volume level of the masker sound, the hearing discomfort caused by a rapid level change can be reduced.

Furthermore, for example, when a vehicle speed included in the vehicle information acquired by the acquisition unit is zero, the adjustment unit may adjust the pitch-shifted masker signal so that a volume level of the masker signal becomes zero or a low level that causes no hearing discomfort regardless of a magnitude of the vehicle information other than the vehicle speed and/or a time-varying value in the vehicle information.

Accordingly, the noise masking device adjusts the pitch-shifted masker signal so that the volume level of the adjusted masker signal becomes zero when the vehicle speed is zero and a noise in a predetermined frequency band is less likely to occur. Therefore, the noise masking device can reduce the volume level of the masker signal to zero at the timing when the noise in the predetermined frequency band is less likely to occur. Therefore, the noise masking device can reduce the unpleasantness felt by a user caused by the output of an unnecessary masker sound.

Furthermore, for example, the noise masking device may further include a storage that stores a table that associates values of a plurality of vehicle information and/or a plurality of time-varying values in the vehicle information with a plurality of volume levels, and the adjustment unit may read a volume level with which the vehicle information acquired by the acquisition unit and/or the time-varying value calculated from the vehicle information are associated in the table stored in the storage, and adjust the pitch-shifted masker signal so that a volume level of the adjusted masker signal becomes the volume level read.

Accordingly it is possible to output a masker sound at a volume level that is appropriate for the occurring noise level.

Furthermore, for example, when vehicle information and/or a time-varying value not included in the table is acquired, the adjustment unit may calculate an interpolation level corresponding to the vehicle information and/or the time-varying value not included in the table from the plurality of vehicle information and/or the plurality of time-varying values and the plurality of volume levels, which are associated with each other in the table, and adjust the pitch-shifted masker signal so that a volume level of the adjusted masker signal becomes the interpolation level calculated.

Accordingly, it is possible to output a masker sound at a volume level that is more appropriate for the occurring noise level.

Furthermore, for example, the acquisition unit may further acquire air conditioner ON/OFF information indicating whether an air conditioner included in the vehicle is in an ON state or an OFF state, and the adjustment unit may adjust the pitch-shifted masker signal so that a volume level of the adjusted masker signal decreases when the air conditioner ON/OFF information acquired by the acquisition unit indicates the ON state.

Accordingly, in a situation where the air conditioner is blowing air and the target noise is less perceivable to the occupants even when the noise masking device does not output the masker sound, the volume level of the masker sound can be reduced. Therefore, the unpleasantness felt by the users caused by the output of an unnecessary masker sound can be reduced.

Furthermore, for example, the acquisition unit may further acquire air volume information indicating an air volume of an air conditioner included in the vehicle, and the adjustment unit may adjust the pitch-shifted masker signal so that a volume level of the adjusted masker signal decreases when the air volume information acquired by the acquisition unit indicates an air volume greater than or equal to a predetermined air volume.

Accordingly, in a situation where the air conditioner is blowing air, and the target noise is less perceivable to the occupants even when the noise masking device does not output the masker sound, the volume level of the masker sound can be reduced. Therefore, the unpleasantness felt by the users caused by the output of an unnecessary masker sound can be reduced.

Furthermore, for example, the acquisition unit may further acquire playback state information indicating whether a sound is being played back by an audio device included in the vehicle, and the adjustment unit may determine whether a sound is being played back based on the playback state information acquired by the acquisition unit, and adjust the pitch-shifted masker signal so that a volume level of the adjusted masker signal decreases when the sound is being played back.

Accordingly, in a situation where sound such as music or the like is being played back by the audio device, and the target noise is less perceivable to the occupants even when the noise masking device does not output the masker sound, the volume level of the masker sound can be reduced. Therefore, the unpleasantness felt by the users caused by the output of an unnecessary masker sound can be reduced.

Furthermore, for example, the acquisition unit may further acquire volume information about an audio device included in the vehicle, and the adjustment unit may determine whether the volume information acquired by the acquisition unit is greater than or equal to a predetermined volume, and adjust the pitch-shifted masker signal so that a volume level of the adjusted masker signal decreases when the volume is greater than or equal to the predetermined volume.

Accordingly, in a situation where sound such as music or the like is being played back by the audio device, and the target noise is less perceivable to the occupants even when the noise masking device does not output the masker sound, the volume level of the masker sound can be reduced. Therefore, the unpleasantness felt by the users caused by the output of an unnecessary masker sound can be reduced.

Furthermore, for example, the acquisition unit may further acquire open/closed state information indicating whether a window of the vehicle is in an open state or a closed state, and the adjustment unit may adjust the pitch-shifted masker signal so that a volume level of the adjusted masker signal decreases when the open/closed state information acquired by the acquisition unit indicates the open state.

Accordingly, in a situation where a window of the vehicle is open, and the target noise is less perceivable to the occupants even when the noise masking device does not output the masker sound, the volume level of the masker sound can be reduced. Therefore, the unpleasantness felt by the users caused by the output of an unnecessary masker sound can be reduced.

Furthermore, for example, the frequency-correlated information correlated to the frequency of the noise may be a real number multiple of the vehicle speed.

Accordingly, the frequency of the masker signal can be determined according to the running speed of the vehicle.

Furthermore, for example, the frequency-correlated information correlated to the frequency of the noise may be a real number multiple of a number of rotations of a motor included in the vehicle.

Accordingly, the frequency of the masker signal can be determined according to the number of rotations of the motor of the vehicle.

Furthermore, for example, the frequency-correlated information correlated to the frequency of the noise may be a real number multiple of a number of rotations of an engine included in the vehicle.

Accordingly, the frequency of the masker signal can be determined according to the number of rotations of the engine of the vehicle.

Furthermore, a vehicle according to an aspect of the present disclosure includes the above-described noise masking device and a speaker that plays back the masker sound according to the adjusted masker signal outputted.

In such a vehicle, the noise masking device pitch-shifts the masker signal generated by the signal source according to the acquired frequency information or frequency-correlated information to generate a pitch-shifted masker signal, performs, on the pitch-shifted masker signal, an adjustment according to the acquired vehicle information and/or the time-varying value in the vehicle information to generate an adjusted masker signal, and outputs the adjusted masker signal as the masker sound. Therefore, the noise masking device can effectively mask a noise in a predetermined frequency band at the timing when the noise occurs.

Furthermore, a noise masking method according to an aspect of the present disclosure includes: acquiring frequency information indicating a frequency of a noise in a vehicle or vehicle information relating to a characteristic of the noise; outputting a masker signal for outputting a masker sound that masks the noise in the vehicle; pitch-shifting the masker signal according to the frequency information or vehicle information acquired, to generate a pitch-shifted masker signal; performing, on the pitch-shifted masker signal, an adjustment according to the vehicle information relating to the characteristic of the noise acquired, to generate an adjusted masker signal; and outputting the adjusted masker signal as the masker sound.

In such a noise masking method, the masker signal generated by the signal source is pitch-shifted according to the acquired frequency information to generate a pitch-shifted masker signal, an adjustment according to the acquired vehicle information is performed on the pitch-shifted masker signal to generate an adjusted masker signal, and the adjusted masker signal is outputted as the masker sound. Therefore, it is possible to effectively mask a noise in a predetermined frequency band at the timing when the noise occurs.

Hereinafter, exemplary embodiments will be specifically described with reference to the drawings. Note that the following exemplary embodiments provide a comprehensive or specific example of the present disclosure. Numerical values, shapes, materials, components, the arrangement and connection of the components, steps, and the order of the steps, for example, illustrated in the exemplary embodiments are mere examples, and therefore are not intended to limit the present disclosure. Furthermore, of the components in the following exemplary embodiments, any component that is not recited in the independent claims indicating the broadest concept is described as an optional component.

Each drawing is a schematic diagram, and is not necessarily a precise illustration. Throughout the drawing, substantially same components are designated by the same reference sign, and there are instances where description is omitted or simplified.

Embodiment

[General Configuration of Vehicle Including Noise Masking Device]

A noise masking device mounted on a vehicle will be described in an exemplary embodiment. FIG. 1 is a schematic diagram illustrating the vehicle including the noise masking device according to the exemplary embodiment.

Vehicle 50 is an example of a mobile body apparatus. Vehicle 50 includes noise masking device 10, rotator 51, vehicle controller 52, first speaker 53*a*, second speaker 53*b*, third speaker 53*c*, audio device 54, vehicle body 55, air conditioner 57, and window 58. Specifically, vehicle 50 is an automobile. However, there is no particular limitation on vehicle 50.

Rotator 51 is a structure disposed in vehicle 50 in order to drive wheels. Rotator 51 is a source of noise in space 56. For example, rotator 51 is disposed in a space different from space 56. Specifically, rotator 51 is mounted in a space formed in a hood of vehicle body 55. Rotator 51 is a rotator used to drive the wheels, such as an engine, a motor, a drive shaft, and a turbocharger (turbine). Rotator 51 may be a rotator used to drive components other than the wheels, such as a motor used in the air conditioner included in vehicle 50.

In particular, rotator 51 produces a motive power to accelerate vehicle 50 when vehicle 50 is running. Alternatively, rotator 51 is a motor that obtains regenerated energy that occurs when vehicle 50 is decelerated. Such a motor is likely to produce a motor electromagnetic noise in a frequency band of several hundred Hz to several kHz because of the electromagnetic compelling force of the motor. Vehicle 50 is a hybrid vehicle or electric vehicle (EV) provided with a motor as rotator 51, for example.

Vehicle controller 52 controls (drives) rotator 51 based on operation by a driver of vehicle 50, for example. Vehicle controller 52 is an electronic control unit (ECU), for example. Specifically, vehicle controller 52 is constructed with a processor, a microcomputer, or a dedicated circuit. Vehicle controller 52 may be constructed with a combination of at least two of the processor, the microcomputer, and the dedicated circuit.

Vehicle controller 52 outputs a pulse signal according to the number of rotations of rotator 51. The pulse signal is an example of information indicating a frequency of a noise (hereinafter, also referred to as a target noise) generated by rotation of rotator 51. In other words, the pulse signal is frequency-correlated information that is correlated to the frequency of the noise in vehicle 50. For example, the frequency of the pulse signal is proportional to the number of rotations (frequency) of rotator 51. Information indicating the frequency of the target noise is not limited to the pulse signal, but may be any information directly or indirectly indicating the frequency of the target noise. For example, the information indicating the frequency of the target noise may be output through an in-vehicle network such as a controller area network (CAN) and Ethernet (registered trademark). For example, the frequency of the target noise is 200 Hz or more. The frequency of the target noise may be 300 Hz to 3 kHz, when the target noise is the motor electromagnetic noise produced when rotator 51 is a motor, for example.

First speaker 53*a* outputs a masker sound according to a masker signal output from noise masking device 10. The masker sound is a sound that masks the target noise in vehicle 50, and is perceived as a noise by occupants. For example, first speaker 53*a* is disposed in a wall (door) on a passenger seat side in vehicle 50, and outputs the masker sound to mask the target noise at first predetermined position 56*a* near the passenger seat. For example, first predetermined position 56*a* is a position at which an occupant is seated in vehicle 50.

Second speaker 53*b* outputs a masker sound according to the masker signal output from noise masking device 10. For example, second speaker 53*b* is disposed in a wall (door) on a driver's seat side in vehicle 50, and outputs the masker sound to mask the target noise at second predetermined position 56*b* near the driver's seat. For example, second predetermined position 56*b* is a position at which an occupant (driver) is seated in vehicle 50.

Third speaker 53*c* is disposed in vehicle 50, and outputs a sound according to an audio signal output from audio device 54. Unlike the masker sound, the sound output from third speaker 53*c* is perceived as music or the like by the occupants.

For the ease of explanation, the arrangement of the speakers shown in FIG. 1 is to mask the target noise at front seats in vehicle 50. In practice, however, the target noise may be masked not only at the front seats but also at the rear seats. In those cases, the speakers are also disposed at the rear seats.

Audio device 54 is what is called a car audio device, and is a device for the occupants of vehicle 50 to listen to music in vehicle 50. For example, audio device 54 can play back a sound (such as music) recorded in a recording disk or a semiconductor memory through third speaker 53*c*.

Vehicle body 55 is a structure constructed with a chassis and a body of vehicle 50, for example. Vehicle body 55 defines space 56 in vehicle 50 (a vehicle interior space) in which first speaker 53*a*, second speaker 53*b*, and third speaker 53*c* are disposed.

Air conditioner 57 is a device that conditions the air in space 56 in vehicle 50. Air conditioner 57 conditions the air in space 56 by cooling, heating or air blowing.

Window 58 is a side window capable of being opened and closed, which is arranged at a side of vehicle 50. When window 58 is opened, space 56 in vehicle 50 and the exterior space are in communication with each other.

[Configuration and Basic Operation of Noise Masking Device]

Figure 2:
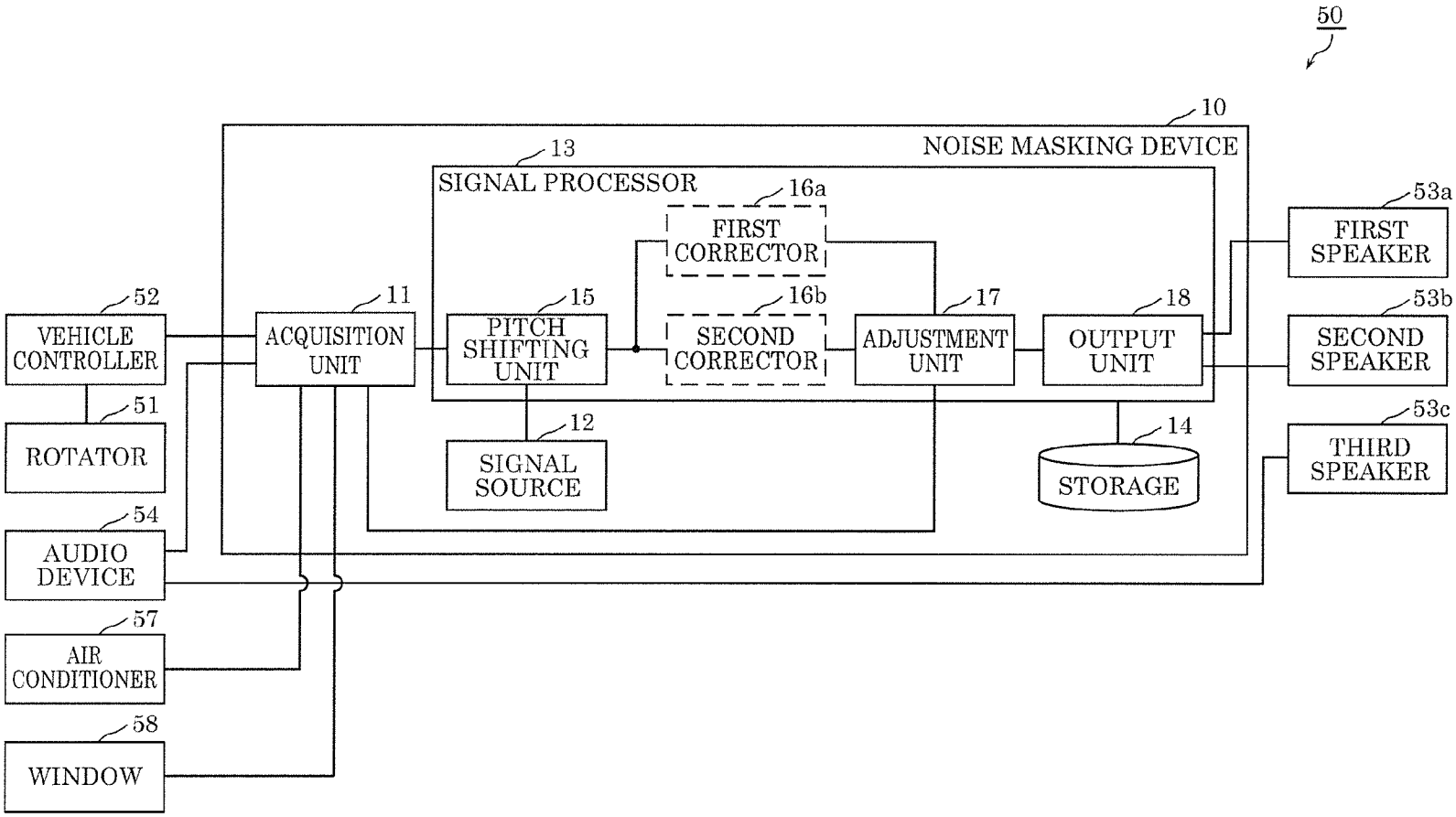
FIG. 2 is a functional block diagram illustrating the noise masking device according to the embodiment.
Figure 3:
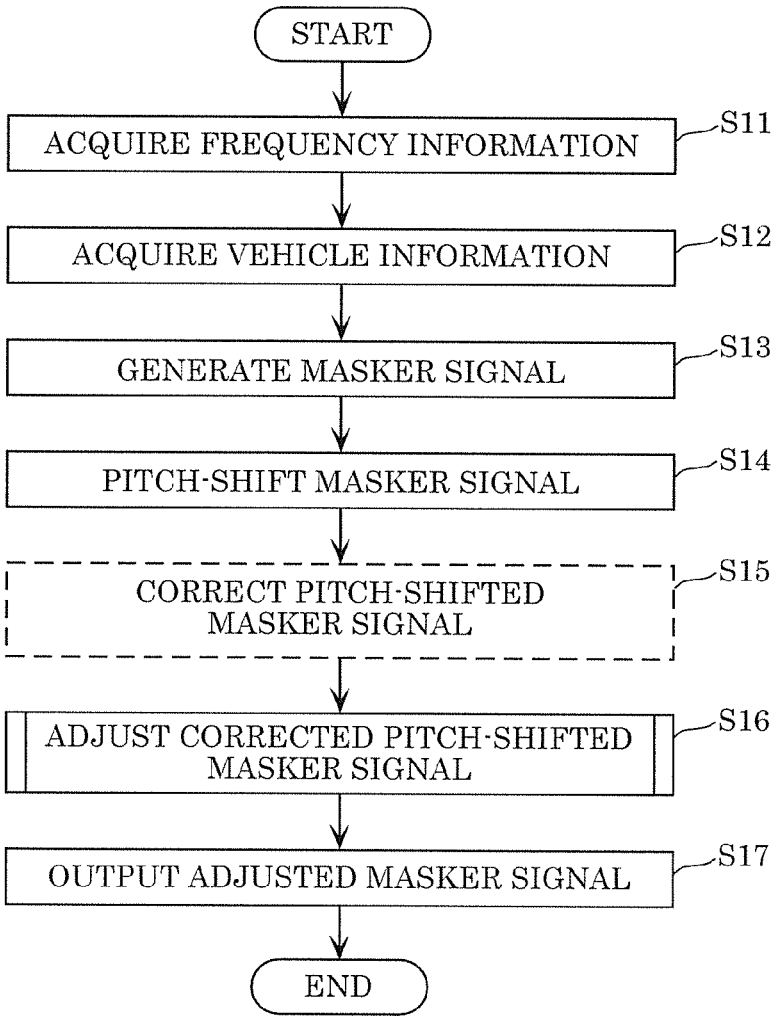
FIG. 3 is a flowchart illustrating a basic operation of the noise masking device according to the embodiment.

A configuration and a basic operation of noise masking device 10 will be described below with reference to FIGS. 2 and 3 in addition to FIG. 1. FIG. 2 is a functional block diagram showing noise masking device 10. FIG. 3 is a flowchart illustrating the basic operation of noise masking device 10.

Noise masking device 10 is a device that makes the target noise, which has a peak at a frequency corresponding to the number of rotations of rotator 51, less perceivable to the occupants. Specifically, noise masking device 10 outputs the masker sound through first speaker 53*a* and second speaker 53*b*.

Therefore, the target noise is masked by the masker sound while a peak level of the target noise is maintained. Since the target noise is made less perceivable to the occupants in this way, noise masking device 10 can reduce the unpleasantness felt by the occupants. Note that masking the noise is different from canceling (reducing) the noise with a sound that is in opposite phase to the noise.

As illustrated in FIG. 2, noise masking device 10 includes acquisition unit 11, signal source 12, signal processor 13, and storage 14. Each component will be described below with reference to FIGS. 1 to 3.

[Acquisition Unit]

Acquisition unit 11 acquires frequency information indicating the frequency of the noise in vehicle 50 (S11). Specifically, acquisition unit 11 acquires the pulse signal corresponding to the number of rotations of rotator 51 from vehicle controller 52 as the frequency information. For example, acquisition unit 11 is a communication module (communication circuit) that acquires the pulse signal from vehicle controller 52 by communication pursuant to a standard of vehicle controller 52 and CAN. However, acquisition unit 11 may be a communication module pursuant to another communications standard, and there is no particular limitation on acquisition unit 11.

In addition, acquisition unit 11 acquires vehicle information relating to characteristic of the noise in vehicle 50 (S12). Acquisition unit 11 acquires the vehicle information from vehicle controller 52. Specifically, the vehicle information includes at least one of motor information and engine information. The motor information is the number of rotations of the motor, or the value of the current flowing through the motor (that is, the motor current value), for example. The engine information is the number of rotations of the engine, or the engine load, for example. Furthermore, the vehicle information may include at least one of the running speed of vehicle 50 (that is, the vehicle speed), the brake oil pressure, the depression amount of the accelerator pedal of vehicle 50, and the number of rotations of the drive shaft and the torque. The vehicle information may be an index value that is a continuous numerical value, or a waveform of an index with respect to another index correlated to the index.

[Signal Source]

Signal source 12 generates the masker signal in order to output the masker sound that masks the noise in vehicle 50 (S13). For example, signal source 12 reads a noise signal (data on the noise signal) stored in storage 14, and generates the masker signal by performing filter processing on the read noise signal. For example, the noise signal is a white noise. However, the noise signal may be another random noise such as a pink noise and is not particularly limited to the random noise. For example, the noise signal may be a signal indicating a background noise in vehicle 50 (a sound signal corresponding to a background noise) acquired by a microphone or the like.

Figure 4:
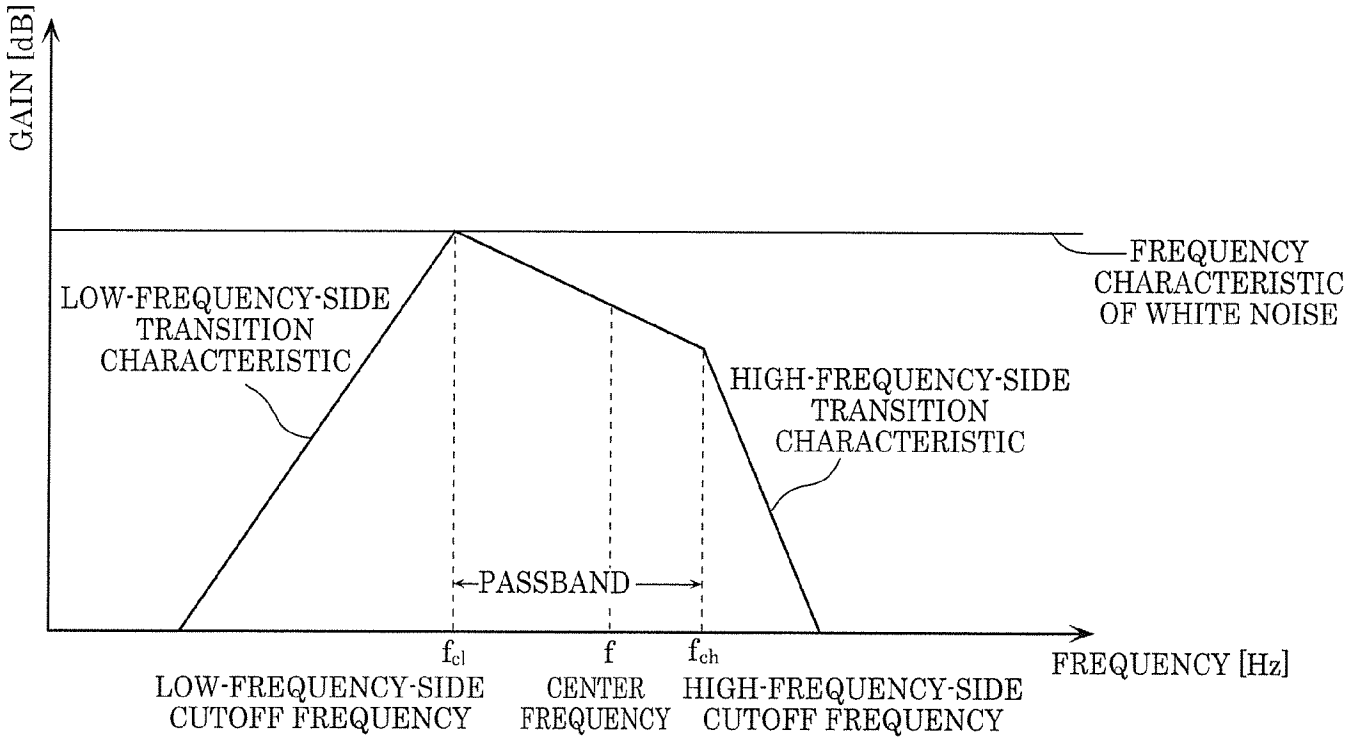
FIG. 4 is a diagram for illustrating a method of generating a masker signal.

A masker signal generating method will be described below with reference to FIG. 4. FIG. 4 is a diagram for illustrating the masker signal generating method. FIG. 4 illustrates a frequency characteristic of the white noise and a filter characteristic of the filter processing performed on the white noise.

For example, signal source 12 generates the masker signal by performing a filter processing using a bandpass filter on the white noise. The bandpass filter provides, to the white noise, a high-frequency-side transition characteristic and a low-frequency-side transition characteristic of the filter characteristic shown in FIG. 4.

Signal source 12 may provide the high-frequency-side transition characteristic and the low-frequency-side transition characteristic to the white noise by using a combination of a low-pass filter and a high-pass filter instead of the bandpass filter. Specifically, signal source 12 may perform, on the white noise, a filter processing using a combination of a low-pass filter having high-frequency-side cutoff frequency fch and the high-frequency-side transition characteristic shown in FIG. 4 and a high-pass filter having low-frequency-side cutoff frequency fcl and the low-frequency-side transition characteristic shown in FIG. 4.

The discomfort caused by the masker sound decreases as a gradient of gain in a passband of the bandpass filter comes closer to a gradient of gain of the background noise in vehicle 50. For this reason, as shown in the filter characteristic in FIG. 4, the bandpass filter has a gradient of gain in the passband. In other words, the filter processing provides the noise signal with a characteristic that the gain attenuates as the frequency increases in the passband of the bandpass filter.

Signal source 12 can provide a gradient of gain in a band corresponding to the passband of the bandpass filter having the filter characteristic by applying a low-pass filter having a transition characteristic of a desired attenuation to the white noise before applying the bandpass filter to the white noise, for example. Signal source 12 may provide a gradient of gain to the band corresponding to the passband in other ways.

When the noise signal is the white noise having a gradient of gain of zero, the gradient of gain in the passband is desirably adjusted in a range of −3 dB/oct to −20 dB/oct inclusive, or more desirably adjusted in a range of −6 dB/oct to −12 dB/oct inclusive. When the noise signal is a random noise having a gain attenuation characteristic, such as the pink noise, a characteristic similar to that in the case where the noise signal is the white noise can be achieved by applying a low-pass filter having a characteristic determined in consideration of the attenuation characteristic of the random noise.

In general, a critical band is defined as a band width beyond which the masking effect of the masker signal is not expected to further improve even when the band of the masker signal is widened. However, when the band of the masker signal is limited within the width of the critical band, the masker sound itself may be conspicuous. In such cases, even though the target noise is masked, the unpleasantness is still not reduced.

According to the findings of the inventors of the present disclosure, the discomfort caused by the masker sound can be reduced by setting the passband of the bandpass filter to be asymmetrical with respect to the center frequency according to an energy distribution of the background noise. Specifically, assuming that the center frequency is f (Hz), low-frequency-side cutoff frequency fcl can be set in a range from f×2^(−2) Hz to f×2^(−⅓) Hz inclusive, and high-frequency-side cutoff frequency fch can be set in a range from f×2^(⅓) Hz to f×2 Hz inclusive.

Signal source 12 is constructed with a processor such as a digital signal processor (DSP), for example. Alternatively, signal source 12 may be constructed with a microcomputer or a dedicated circuit, or a combination of at least two of the processor, the microcomputer, and the dedicated circuit. Signal source 12 may be constructed as a part of signal processor 13.

Storage 14 in which the data on the noise signal is stored is constructed with a semiconductor memory, for example. In addition to the data on the noise signal, storage 14 stores a filter coefficient used in the filter processing of the signal source and a control program executed by signal processor 13, for example.

[Signal Processor: Pitch Shifting Unit]

Then, signal processor 13 performs signal processing on the masker signal output from signal source 12, and outputs an adjusted masker signal having been subjected to the signal processing to first speaker 53*a* and second speaker 53*b* (S14 to S17). Specifically, signal processor 13 includes pitch shifting unit 15, adjustment unit 17, and output unit 18. Signal processor 13 may further include first corrector 16*a* and second corrector 16*b*. Signal processor 13 is constructed with a processor such as a DSP, for example. Alternatively, signal processor 13 may be constructed with a microcomputer or a dedicated circuit, or a combination of at least two of the processor, the microcomputer, and the dedicated circuit.

Figure 5:
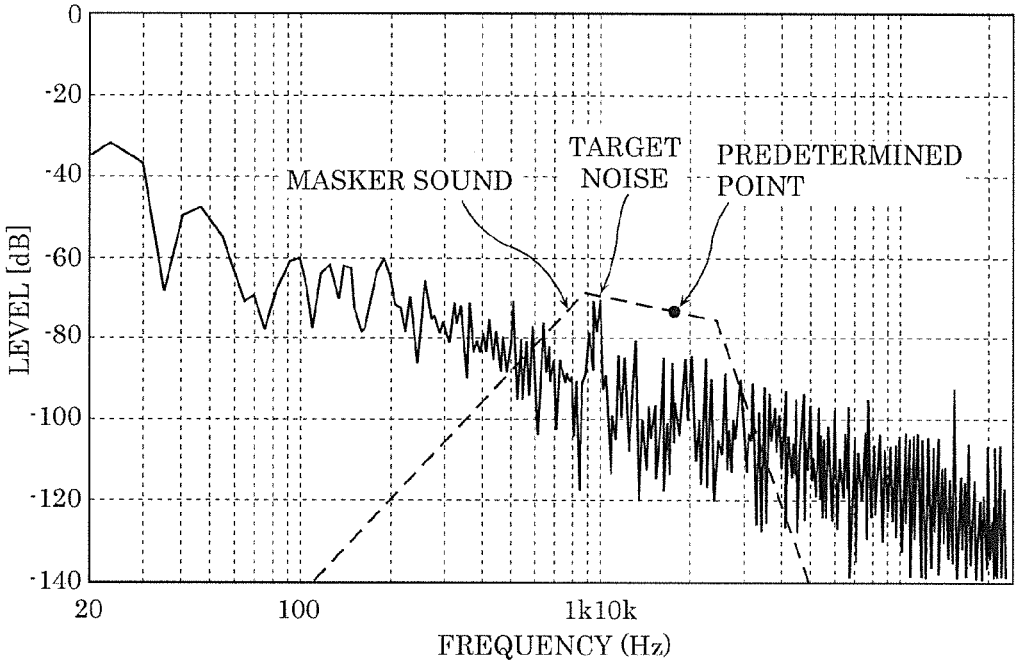
FIG. 5 is a first diagram for illustrating pitch shifting performed by a pitch shifting unit.
Figure 6:
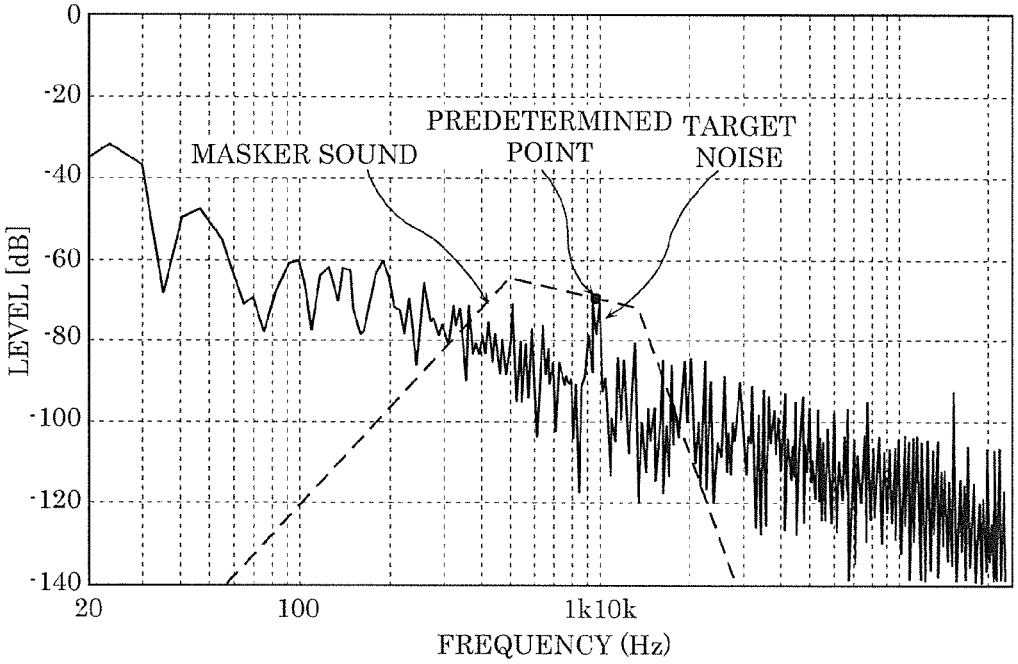
FIG. 6 is a second diagram for illustrating the pitch shifting performed by the pitch shifting unit.

Pitch shifting unit 15 first generates a pitch-shifted masker signal by performing pitch shifting on the masker signal according to the frequency information acquired by acquisition unit 11 (S14). FIGS. 5 and 6 are diagrams illustrating the pitch shifting performed by pitch shifting unit 15. FIGS. 5 and 6 show a frequency characteristic of the noise in vehicle 50 (solid line) and a schematic frequency characteristic of the masker signal (masker sound) (broken line).

When the masker signal generated by signal source 12 has the frequency characteristic shown by the broken line in FIG. 5, pitch shifting unit 15 performs pitch shifting of the masker signal in such a manner that the frequency (center frequency f) of the masker signal at a predetermined point on the signal waveform coincides with the frequency of the target noise. Alternatively, pitch shifting unit 15 may perform pitch shifting of the masker signal in such a manner that center frequency f of the masker signal coincides with a real number multiple of the vehicle speed of vehicle 50 as the frequency of the target noise. Alternatively, pitch shifting unit 15 may perform pitch shifting of the masker signal in such a manner that center frequency f of the masker signal coincides with a real number multiple of the number of rotations of the motor of vehicle 50 as the frequency of the target noise. Alternatively, pitch shifting unit 15 may perform pitch shifting of the masker signal in such a manner that center frequency f of the masker signal coincides with a real number multiple of the number of rotations of the engine of vehicle 50 as the frequency of the target noise. Alternatively, pitch shifting unit 15 may perform the pitch shifting in such a manner that center frequency f of the masker signal coincides with a real number multiple of the number of rotations of rotator 51 as the frequency of the target noise. As a result, the frequency characteristic of the masker signal changes to the characteristic shown by the broken line in FIG. 6. The pitch-shifted masker signal resulting from the pitch shifting is output to first corrector 16*a* and second corrector 16*b*.

[Signal Processor: Corrector]

Then, each of first corrector 16*a* and second corrector 16*b* corrects the pitch-shifted masker signal (S15).

First corrector 16*a* performs a correction for first predetermined position 56*a* on the masker signal pitch-shifted by pitch shifting unit 15. Second corrector 16*b* performs a correction for second predetermined position 56*b* on the masker signal pitch-shifted by pitch shifting unit 15. Since first predetermined position 56*a* differs from second predetermined position 56*b*, the correction performed by second corrector 16*b* is different from the correction performed by first corrector 16*a*. In other words, a correction for a predetermined position is a correction that optimizes the masker sound at the predetermined position. That is, a correction for a predetermined position is a correction that improves the effect of the masker sound at the predetermined position compared to any other position.

As the corrections for the respective predetermined positions, first corrector 16*a* and second corrector 16*b* multiply the pitch-shifted masker signal by a coefficient, for example. The coefficient is, in other words, a gain in this case, and is a uniform value for the entire frequency band of the pitch-shifted masker signal.

As the corrections for the respective predetermined positions, first corrector 16*a* and second corrector 16*b* may perform filter processing on the pitch-shifted masker signal. In other words, first corrector 16*a* and second corrector 16*b* may provide a different gain to the pitch-shifted masker signal in each frequency band.

As the corrections for the respective predetermined positions, first corrector 16*a* and second corrector 16*b* may perform processing of changing a phase of the pitch-shifted masker signal. For example, first corrector 16*a* and second corrector 16*b* perform all pass filter (APF) processing to change the phase of the pitch-shifted masker signal.

As the corrections for the respective predetermined positions, first corrector 16*a* and second corrector 16*b* may perform a combination of at least two of the multiplication of a coefficient, the filter processing, and the processing of changing the phase.

[Signal Processor: Adjustment Unit]

Then, adjustment unit 17 generates an adjusted masker signal by performing an adjustment according to the vehicle information acquired by acquisition unit 11 on the pitch-shifted masker signal (S16). Specifically, adjustment unit 17 performs an adjustment according to the vehicle information on each of the pitch-shifted masker signal corrected by first corrector 16*a* and the pitch-shifted masker signal corrected by second corrector 16*b*.

Adjustment unit 17 may adjust the pitch-shifted masker signal in such a manner that the volume level of the adjusted masker signal changes according to the vehicle information relating to the characteristic of the noise and/or a time-varying value in the vehicle information. In that case, adjustment unit 17 may adjust the pitch-shifted masker signal in such a manner that the volume level of the adjusted masker signal changes over a transition time.

Specifically, adjustment unit 17 performs any of first to third examples of specific adjustment processing shown in FIGS. 7 to 9 described below. The thresholds and the predetermined transition time in each of the first to third examples are independent from those in the other examples, and the threshold or transition time referred to by the same term may assume a different numerical.

Figure 7:
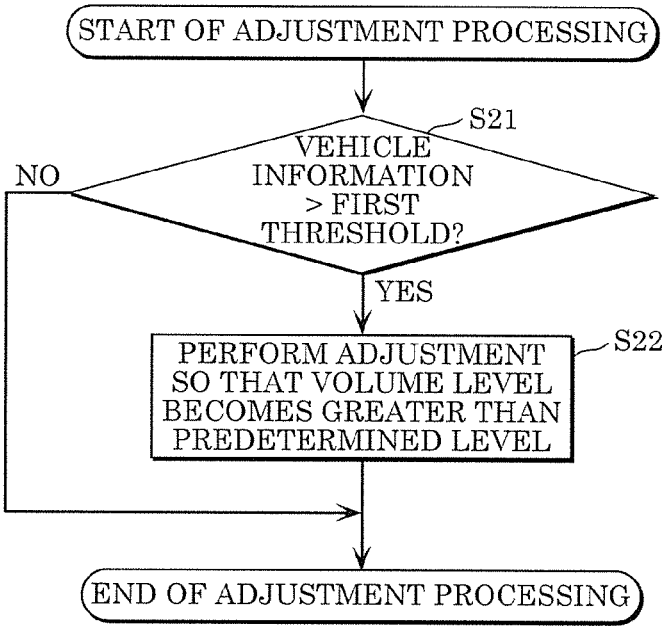
FIG. 7 is a flowchart illustrating a first example of specific adjustment processing performed by an adjustment unit.

FIG. 7 is a flowchart illustrating a first example of specific adjustment processing performed by adjustment unit 17.

Adjustment unit 17 determines whether or not at least one of the number of rotations of the motor, the motor current value, the number of rotations of the engine, the engine load, the vehicle speed, the brake oil pressure, the depression amount of the accelerator pedal, and the number of rotations of the drive shaft and the torque included in the vehicle information is greater than a first threshold (S21). The first threshold may be set for each of at least one of the number of rotations of the motor, the motor current value, the number of rotations of the engine, the engine load, the vehicle speed, the brake oil pressure, the depression amount of the accelerator pedal, and the number of rotations of the drive shaft and the torque included in the vehicle information. That is, the first threshold may be set at a different value depending on the type of the vehicle information.

When the vehicle information is greater than the first threshold (Yes in S21), adjustment unit 17 adjusts the pitch-shifted masker signal so that the volume level of the adjusted masker signal becomes greater than a predetermined level (S22). In this case, adjustment unit 17 may adjust the pitch-shifted masker signal so that the volume level of the adjusted masker signal becomes greater than the predetermined level over a predetermined transition time. That is, when adjusting the pitch-shifted masker signal so that the volume level of the adjusted masker signal becomes greater than the predetermined level, adjustment unit 17 can adjust the pitch-shifted masker signal so that the adjusted masker signal fades in. In this way, the boundary of the masker signal, which is caused by repeated consecutive use of the masker signal, is made less perceivable to the occupants. In addition, in adjustment of the volume level of the masker sound, the hearing discomfort caused by a rapid level change can be reduced.

In this way, in the first example of adjustment processing, when at least one of the values of the number of rotations of the motor, the motor current value, the number of rotations of the engine, the engine load, the vehicle speed, the brake oil pressure, the depression amount of the accelerator pedal, and the number of rotations of the drive shaft and the torque included in the vehicle information is greater than a first threshold set for the vehicle information, the pitch-shifted masker signal is adjusted so that the volume level of the masker signal becomes greater than the predetermined level.

Thus, in the first example, when the vehicle information is greater than the first threshold, and a noise in a predetermined frequency band is likely to occur, noise masking device 10 adjusts the pitch-shifted masker signal so that the volume level of the masker sound becomes greater than the predetermined level above which the masker sound can mask the noise. Therefore, noise masking device 10 can effectively mask the noise in the predetermined frequency band at the timing when the noise occurs.

Figure 8:
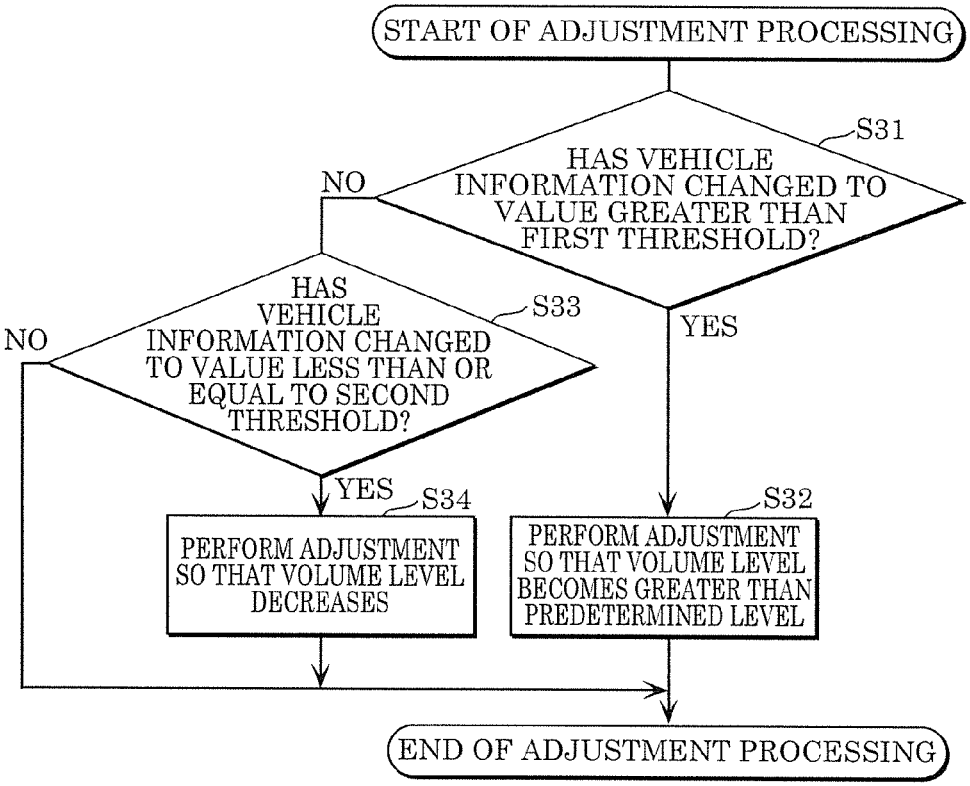
FIG. 8 is a flowchart illustrating a second example of specific adjustment processing performed by an adjustment unit.

FIG. 8 is a flowchart illustrating a second example of specific adjustment processing performed by adjustment unit 17.

Adjustment unit 17 determines whether or not at least one of the number of rotations of the motor, the motor current value, the number of rotations of the engine, the engine load, the vehicle speed, the brake oil pressure, the depression amount of the accelerator pedal, and the number of rotations of the drive shaft and the torque included in the vehicle information acquired by acquisition unit 11 has changed from a value less than or equal to the first threshold to a value greater than the first value (S31).

When the vehicle information has changed from a value less than or equal to the first threshold to a value greater than the first threshold (Yes in S31), adjustment unit 17 adjusts the pitch-shifted masker signal so that the volume level of the adjusted masker signal becomes greater than a predetermined level (S32). In this case, adjustment unit 17 may adjust the pitch-shifted masker signal so that the volume level of the adjusted masker signal becomes greater than the predetermined level over a predetermined transition time. That is, when adjusting the pitch-shifted masker signal so that the volume level of the adjusted masker signal becomes greater than the predetermined level, adjustment unit 17 can adjust the pitch-shifted masker signal so that the adjusted masker signal fades in.

On the other hand, when the vehicle information has not changed from a value less than or equal to the first threshold to a value greater than the first threshold (No in S31), adjustment unit 17 determines whether or not the vehicle information has changed from a value greater than a second threshold, which is greater than the first threshold, to a value less than or equal to the second threshold (S33).

When the vehicle information has changed from a value greater than the second threshold to a value less than or equal to the second threshold (Yes in S33), adjustment unit 17 adjusts the pitch-shifted masker signal so that the volume level of the adjusted masker signal decreases (S34). In this case, adjustment unit 17 may adjust the pitch-shifted masker signal so that the volume level of the adjusted masker signal decreases over a predetermined transition time. That is, when adjusting the pitch-shifted masker signal so that the volume level of the adjusted masker signal decreases, adjustment unit 17 can adjust the pitch-shifted masker signal so that the adjusted masker signal fades out.

Thus, in the second example, when the vehicle information is greater than the first threshold, and a noise in a predetermined frequency band is likely to occur, noise masking device 10 adjusts the pitch-shifted masker signal so that the volume level of the adjusted masker sound becomes greater than the predetermined level above which the masker sound can mask the noise. Therefore, noise masking device 10 can effectively mask the noise in the predetermined frequency band at the timing when the noise occurs. In addition, when the vehicle information is less than or equal to the second threshold, and the noise in the predetermined frequency band is less likely to occur, noise masking device 10 adjusts the pitch-shifted masker signal so that the volume level of the adjusted masker sound decreases. Therefore, noise masking device 10 can reduce the volume level of the masker sound at the timing when the noise in the predetermined frequency band is less likely to occur. In this way, noise masking device 10 can reduce the unpleasantness felt by users when the masker sound is unnecessarily output.

In addition, since a fade-in or fade-out is adopted when adjusting the volume, the boundary of the masker sound, which is caused by repeated consecutive use of the masker signal, is made less perceivable to the occupants. In addition, in adjustment of the volume level of the masker sound, the hearing discomfort caused by a rapid level change can be reduced.

Figure 9:
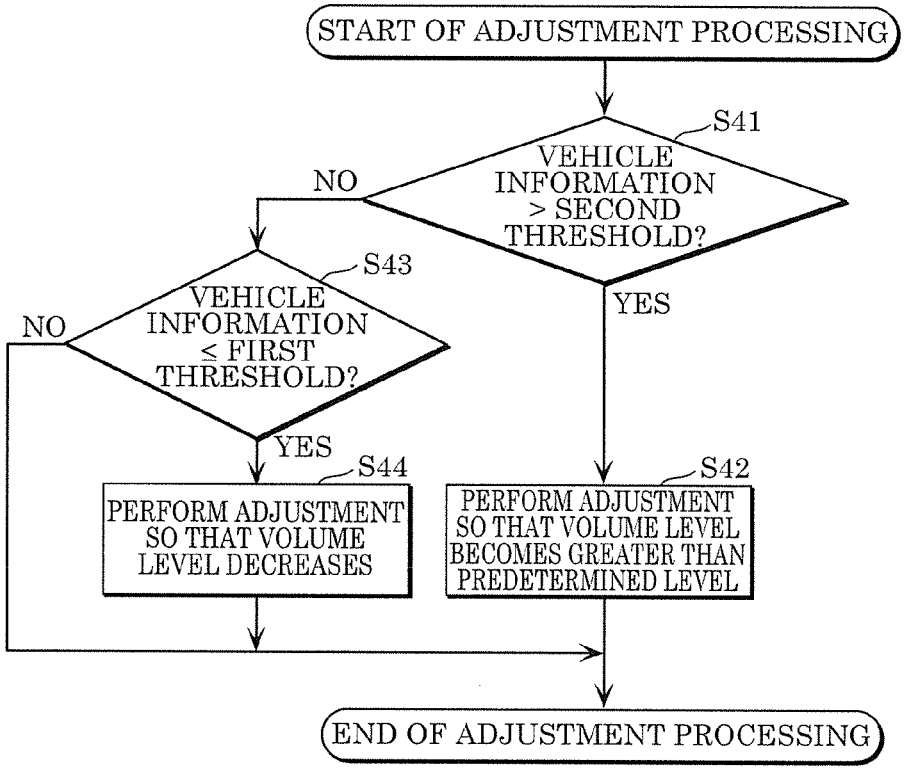
FIG. 9 is a flowchart illustrating a third example of specific adjustment processing performed by an adjustment unit.

FIG. 9 is a flowchart illustrating a third example of specific adjustment processing performed by adjustment unit 17.

Adjustment unit 17 determines whether or not at least one of the number of rotations of the motor, the motor current value, the number of rotations of the engine, the engine load, the vehicle speed, the brake oil pressure, the depression amount of the accelerator pedal, and the number of rotations of the drive shaft and the torque included in the vehicle information acquired by acquisition unit 11 is greater than the second threshold (S41).

When the vehicle information is greater than the second threshold (Yes in S41), adjustment unit 17 adjusts the pitch-shifted masker signal so that the volume level of the adjusted masker signal becomes greater than a predetermined level (S42). In this case, adjustment unit 17 may adjust the pitch-shifted masker signal so that the volume level of the adjusted masker signal becomes greater than the predetermined level over a predetermined transition time. That is, when adjusting the pitch-shifted masker signal so that the volume level of the adjusted masker signal becomes greater than the predetermined level, adjustment unit 17 can adjust the pitch-shifted masker signal so that the adjusted masker signal fades in.

On the other hand, when the vehicle information is less than or equal to the second threshold (No in S41), adjustment unit 17 determines whether or not at least one of the number of rotations of the motor, the motor current value, the number of rotations of the engine, the engine load, the vehicle speed, the brake oil pressure, the depression amount of the accelerator pedal, and the number of rotations of the drive shaft and the torque included in the vehicle information acquired by acquisition unit 11 has become less than or equal to the first threshold, which is smaller than the second threshold (S43).

When the vehicle information is less than or equal to the first threshold (Yes in S43), adjustment unit 17 adjusts the pitch-shifted masker signal so that the volume level of the adjusted masker signal decreases (S44). In this case, adjustment unit 17 may adjust the pitch-shifted masker signal so that the volume level of the adjusted masker signal decreases over a predetermined transition time. That is, when adjusting the pitch-shifted masker signal so that the volume level of the adjusted masker signal decreases, adjustment unit 17 can adjust the pitch-shifted masker signal so that the adjusted masker signal fades out.

Thus, in the third example, when the vehicle information is greater than the second threshold, and a noise in a predetermined frequency band is likely to occur, noise masking device 10 adjusts the pitch-shifted masker signal so that the volume level of the adjusted masker sound becomes greater than the predetermined level above which the masker sound can mask the noise. Therefore, noise masking device 10 can effectively mask the noise in the predetermined frequency band at the timing when the noise occurs. In addition, when the vehicle information is less than or equal to the first threshold, and the noise in the predetermined frequency band is less likely to occur, noise masking device 10 adjusts the pitch-shifted masker signal so that the volume level of the adjusted masker signal decreases. Therefore, noise masking device 10 can reduce the volume level of the masker sound at the timing when the noise in the predetermined frequency band is less likely to occur. In this way, noise masking device 10 can reduce the unpleasantness felt by users because of an unnecessary masker sound.

In addition, since a fade-in or fade-out is adopted when adjusting the volume, the boundary of the masker sound, which is caused by repeated consecutive use of the masker signal, is made less perceivable to the occupants. In addition, in adjustment of the volume level of the masker sound, the hearing discomfort caused by a rapid level change can be reduced.

Next, a relationship between the noise in space 56 in vehicle 50 and the number of rotations of the motor, the brake oil pressure, the depression amount of the accelerator pedal, and the torque will be described with reference to FIGS. 10 to 14.

Figure 10:
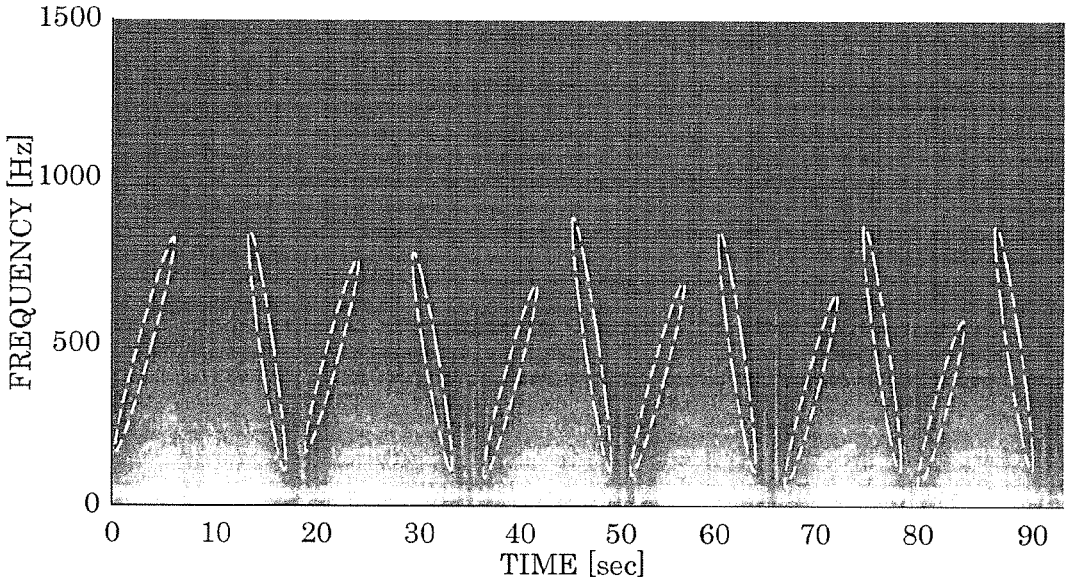
FIG. 10 is a graph showing a temporal variation of the frequency and level of a noise measured in a space in a vehicle.
Figure 11:
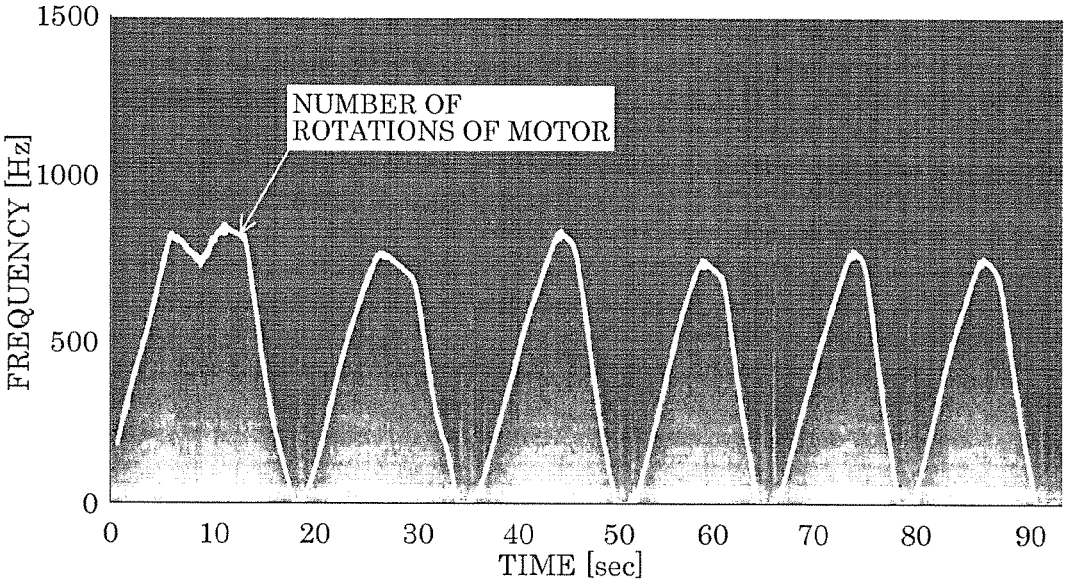
FIG. 11 is a graph showing a temporal variation of the number of rotations of a motor superimposed on the graph in FIG. 10 on the same time base.
Figure 12:
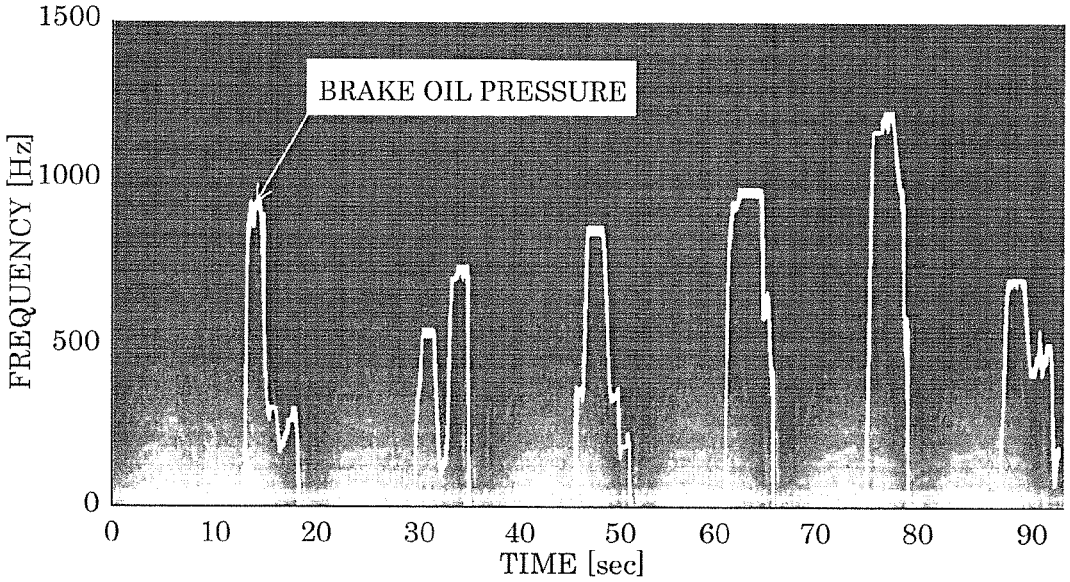
FIG. 12 is a graph showing a temporal variation of the brake oil pressure superimposed on the graph in FIG. 10 on the same time base.
Figure 13:
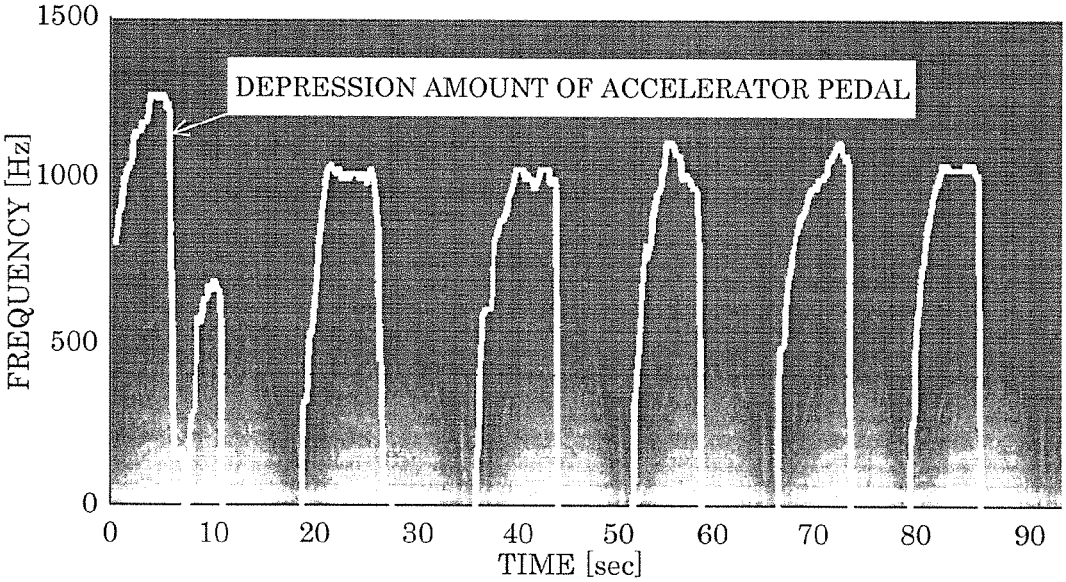
FIG. 13 is a graph showing a temporal variation of the accelerator pedal depression amount superimposed on the graph in FIG. 10 on the same time base.
Figure 14:
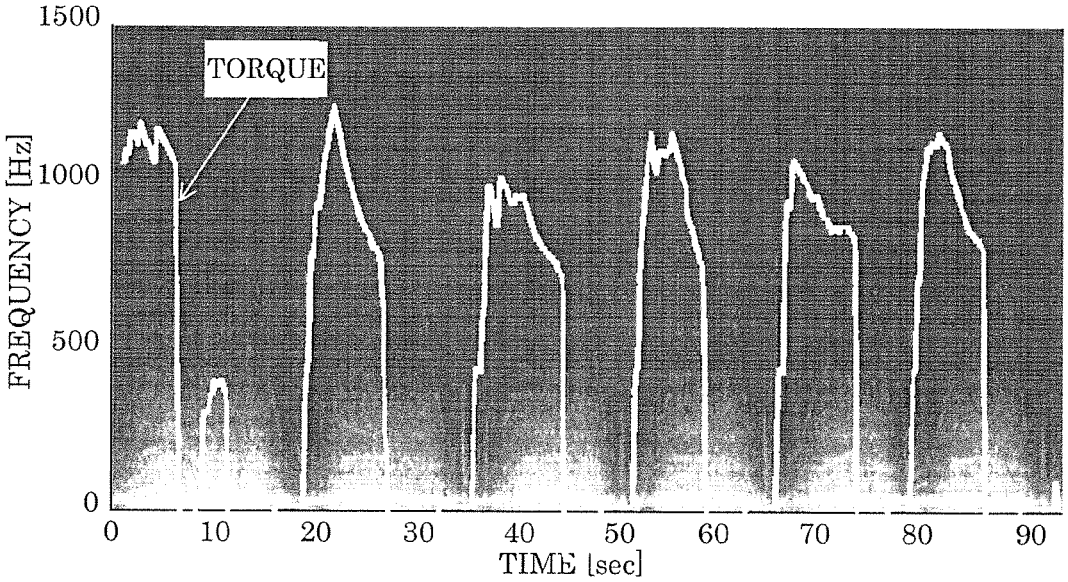
FIG. 14 is a graph showing a temporal variation of the torque superimposed on the graph in FIG. 10 on the same time base.

FIG. 10 is a graph showing a temporal variation of the frequency and level of the noise measured in space 56 in vehicle 50. FIG. 11 is a graph showing a temporal variation of the number of rotations of the motor superimposed on the graph in FIG. 10 on the same time base. FIG. 12 is a graph showing a temporal variation of the brake oil pressure superimposed on the graph in FIG. 10 on the same time base. FIG. 13 is a graph showing a temporal variation of the depression amount of the accelerator pedal superimposed on the graph in FIG. 10 on the same time base. FIG. 14 is a graph showing a temporal variation of the torque superimposed on the graph in FIG. 10 on the same time base.

The temporal variation of the frequency and level of the noise, the temporal variation of the number of rotations of the motor, the temporal variation of the brake oil pressure, the temporal variation of the depression amount of the accelerator pedal, and the temporal variation of the torque shown in FIGS. 10 to 14 are results of measurement made while vehicle 50 runs for the same period.

FIG. 10 shows that in regions enclosed by a broken line or an alternate long and short dash line, a relatively high noise level is measured in a high frequency range of 200 Hz to 1000 Hz.

For example, superimposing the graph of the temporal variation of the number of rotations of the motor on the graph in FIG. 10 as shown in FIG. 11 shows that the time zones of the regions enclosed by a broken line or an alternate long and short dash line in FIG. 10 coincide with time zones in which the number of rotations of the motor increases or decreases. That is, it can be said that the target noise in the high frequency band of 200 Hz to 1000 Hz occurs in the time zones in which the number of rotations of the motor increases or decreases, and that the target noise in the high frequency band of 200 Hz to 1000 Hz occurs in the time zones in which vehicle 50 is being accelerated or decelerated.

In addition, for example, superimposing the graph of the temporal variation of the brake oil pressure on the graph in FIG. 10 as shown in FIG. 12 shows that the time zones of the regions enclosed by a broken line or an alternate long and short dash line in FIG. 10 coincide with time zones in which the brake oil pressure increases. That is, it can be said that the target noise in the high frequency band of 200 Hz to 1000 Hz occurs in the time zones in which the brake oil pressure is higher than a predetermined oil pressure, and that the target noise in the high frequency band of 200 Hz to 1000 Hz occurs in the time zones in which vehicle 50 is being decelerated.

In addition, for example, superimposing the graph of the temporal variation of the depression amount of the accelerator pedal on the graph in FIG. 10 as shown in FIG. 13 shows that the time zones of the regions enclosed by a broken line or an alternate long and short dash line in FIG.

10 coincide with time zones in which the depression amount of the accelerator pedal increases. That is, it can be said that the target noise in the high frequency band of 200 Hz to 1000 Hz occurs in the time zones in which the depression amount of the accelerator pedal is greater than a predetermined opening, and that the target noise in the high frequency band of 200 Hz to 1000 Hz occurs in the time zones in which vehicle 50 is being accelerated.

In addition, for example, superimposing the graph of the temporal variation of the torque on the graph in FIG. 10 as shown in FIG. 14 shows that the time zones of the regions enclosed by a broken line or an alternate long and short dash line in FIG. 10 coincide with time zones in which the torque increases. That is, it can be said that the target noise in the high frequency band of 200 Hz to 1000 Hz occurs in the time zones in which the torque is higher than a predetermined torque, and that the target noise in the high frequency band of 200 Hz to 1000 Hz occurs in the time zones in which vehicle 50 is being accelerated.

[Signal Processor: Output Unit]

Then, output unit 18 outputs the adjusted masker signal (S17). Specifically, output unit 18 outputs the masker signal that is corrected by first corrector 16*a* and then adjusted to first speaker 53*a*. Based on the masker signal, first speaker 53*a* outputs the masker sound that masks the target noise felt at first predetermined position 56*a*.

Output unit 18 outputs the masker signal that is corrected by second corrector 16*b* and then adjusted to second speaker 53*b*. Based on the masker signal, second speaker 53*b* outputs the masker sound that masks the target noise felt at second predetermined position 56*b*.

In this way, the target noise is masked by the masker sound and is thereby made less perceivable to the occupants. That is, noise masking device 10 can reduce the unpleasantness of the target noise felt by the occupants.

The masker sound is output from the speakers for a predetermined period, for example. In the case where the masker sound is output for a period longer than the predetermined period, the masker signal corresponding to the masker sound is repeatedly used. In this regard, the masker sound can have a characteristic that the volume fades in and fades out. This makes the boundary of the masker sound caused by repeated consecutive use of the masker signal less perceivable to the occupants.

(Effects)

In the embodiment, the subject noise has a frequency that is a real number multiple of the number of rotations of the motor. However, when the subject noise has a volume greater than or equal to a predetermined volume level, the subject noise is conspicuous and unpleasant for the users. On the other hand, the subject noise actually is less likely to constantly have a volume greater than or equal to the predetermined volume level, and the volume level sometimes decreases below the predetermined volume level. Therefore, when the output of the masker sound is controlled simply based on the number of rotations of the motor, the masker signal can be output even when the volume level of the subject noise is lower than the predetermined volume level, and this can lead to the unpleasantness of the masker sound felt by the users.

Noise masking device 10 according to this embodiment pitch-shifts the masker signal generated by signal source 12 according to the acquired frequency information to generate a pitch-shifted masker signal, performs, on the pitch-shifted masker signal, an adjustment according to the acquired vehicle information to generate an adjusted masker signal, and outputs the adjusted masker signal as the masker sound. Therefore, noise masking device 10 can effectively mask a noise in a predetermined frequency band at the timing when the noise occurs. Accordingly, it is possible to effectively mask noise occurring at a predetermined volume level or higher, thereby reducing the unpleasantness felt by the user.

Furthermore, in the same manner, since noise masking device 10 is capable of effectively masking a noise in a predetermined frequency band at the timing when the noise occurs, it is possible, for example, to not output a masker sound at a timing when sound that is greater than or equal to a predetermined volume level does not occur. Accordingly, it is possible to reduce the unpleasantness felt by the user caused by the output of an unnecessary masker sound.

Furthermore, noise masking device 10 performs, on the pitch-shifted masker signal, an adjustment according to the acquired information on the motor of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired information on the engine of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired information on the engine and/or information on the motor of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired number of rotations of the motor of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired motor current value of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Therefore, noise masking device 10 performs, on the pitch-shifted masker signal, an adjustment according to the acquired number of rotations of the engine of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired engine load of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired vehicle speed of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired brake oil pressure of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired depression amount of the accelerator pedal of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired number of rotations of the drive shaft of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, noise masking device 10 performs, on the pitch-shifted masker signal, an adjustment according to the acquired torque of vehicle 50 to generate an adjusted masker signal, and outputs the adjusted masker signal as the masker sound from the output unit. Therefore, noise masking device 10 can effectively mask a noise in a predetermined frequency band at the timing when the noise occurs.

Furthermore, the frequency-correlated information correlated to the frequency of the noise may be a real number multiple of the running speed of vehicle 50. Accordingly, noise masking device 10 can determine the frequency of the masker signal according to the running speed of vehicle 50.

Furthermore, the frequency-correlated information correlated to the frequency of the noise may be a real number multiple of a number of rotations of a motor included in vehicle 50. Accordingly, noise masking device 10 can determine the frequency of the masker signal according to the number of rotations of the motor of vehicle 50.

Furthermore, the frequency-correlated information correlated to the frequency of the noise may be a real number multiple of a number of rotations of an engine included in vehicle 50. Accordingly, noise masking device 10 can determine the frequency of the masker signal according to the number of rotations of the engine of vehicle 50.

Operation Example 1

Operation Example 1 of noise masking device 10, which is different from the basic operation, will be described below.

Figure 15:
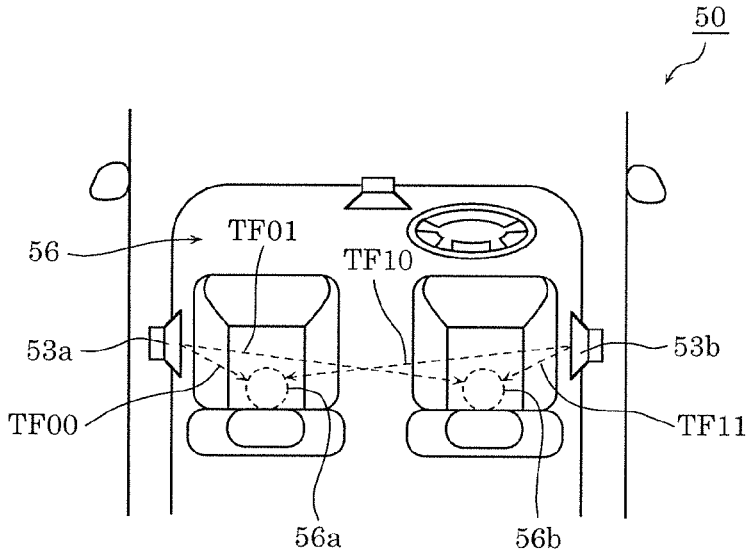
FIG. 15 is a diagram illustrating transfer functions in the vehicle.

In order to correct the masker signal with high accuracy, first corrector 16*a* may calculate the volume of the masker sound at first predetermined position 56*a* based on a transfer function (transfer characteristic). FIG. 15 is a diagram illustrating transfer functions in vehicle 50. The transfer functions are actually measured in space 56 in vehicle 50 in advance, and stored in storage 14.

As illustrated in FIG. 15, a transfer function from first speaker 53*a* to first predetermined position 56*a* is expressed as TF00, and a transfer function from first speaker 53*a* to second predetermined position 56*b* is expressed as TF01. A transfer function from second speaker 53*b* to first predetermined position 56*a* is expressed as TF10, and a transfer function from second speaker 53*b* to second predetermined position 56*b* is expressed as TF11.

Masker signal x0 (masker sound) at first predetermined position 56*a* is given by Equation 1 below, provided that the pitch-shifted masker signal is denoted as x, the correction performed by first corrector 16*a* is denoted by A0, and the correction performed by second corrector 16*b* is denoted as A1. Similarly, masker signal x1 (masker sound) at second predetermined position 56*b* is given by Equation 2 below.

$$x0=(x*A0)*TF00+(x*A1)*TF10 \quad \text{(Equation 1)}$$

$$x1=(x*A0)*TF01+(x*A1)*TF11 \quad \text{(Equation 2)}$$

First corrector 16*a* can specify the level of the masker sound at first predetermined position 56*a* by calculation according to Equation 1 above. Thus, as a correction for first predetermined position 56*a*, first corrector 16*a* can perform a correction on the pitch-shifted masker signal to make the masker sound at first predetermined position 56*a* louder than the target noise by a predetermined level or more. Specifically, first corrector 16*a* performs a correction that makes the signal level of the same frequency component of the pitch-shifted masker signal as the target noise greater than the signal level of the target noise by the predetermined level or more.

Similarly, second corrector 16*b* can specify the level of the masker sound at second predetermined position 56*b* by calculation according to Equation 2 above. Thus, as a correction for second predetermined position 56*b*, second corrector 16*b* can perform a correction on the pitch-shifted masker signal to make the masker sound at second predetermined position 56*b* louder than the target noise by a predetermined level or more.

Through the above corrections, noise masking device 10 can prevent the masker sound from being insufficient in volume and effectively mask the target noise.

When the masker sound is too loud, as a correction for first predetermined position 56*a*, first corrector 16*a* may perform a correction on the pitch-shifted masker signal to make the masker sound at first predetermined position 56*a* smaller than the target noise by a predetermined level or more. That is, first corrector 16*a* may perform a correction that makes the difference in magnitude between the masker sound and the target noise at the predetermined position larger than the predetermined level or more. The same holds true for second corrector 16*b*.

Operation Example 2

Figure 16:
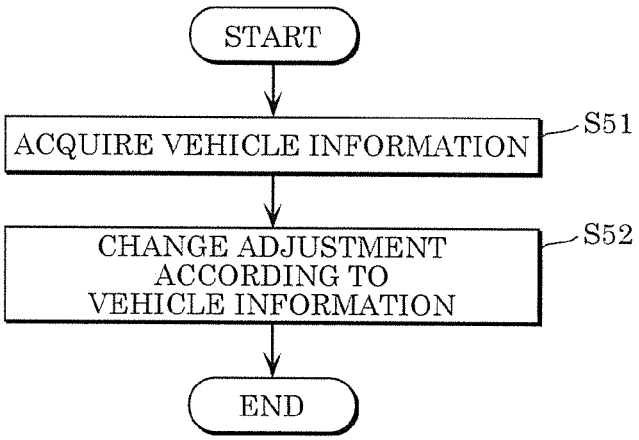
FIG. 16 is a flowchart illustrating Operation Example 2 of the noise masking device according to the embodiment.

Operation Example 2 of noise masking device 10 will be described below. The target noise is caused by rotation of rotator 51 as described above, and changes with a running state of vehicle 50 when rotator 51 is used to drive the wheels. To cope with this, adjustment unit 17 can dynamically change the adjustment performed on the pitch-shifted masker signal each time the running state changes. FIG. 16 is a flowchart illustrating Operation Example 2.

In Operation Example 2, acquisition unit 11 acquires vehicle information indicating the running state of vehicle 50 (which changes as vehicle 50 runs) from vehicle controller 52, and outputs the vehicle information to signal processor 13 (adjustment unit 17) (S51). The vehicle information is the same as the vehicle information described above with regard to the basic operation.

Adjustment unit 17 changes the adjustment performed on the pitch-shifted masker signal according to the acquired vehicle information (S52). For example, when performing an adjustment that involves multiplication by a coefficient (gain), adjustment unit 17 increases the gain by which the pitch-shifted masker signal is multiplied as the volume of the target noise increases in the running state determined based on the acquired vehicle information. In this way, the masker sound can be prevented from being insufficient in volume.

As described above, adjustment unit 17 may adjust the pitch-shifted masker signal according to the vehicle information indicating the running state of vehicle 50. In this way, noise masking device 10 can output the masker signal in consideration of the running state of vehicle 50.

Operation Example 3

Operation Example 3 of noise masking device 10 will be described below. In space 56 in vehicle 50, music or the like may be played back by audio device 54 and third speaker 53*c*. In such a case, when the masker sound is output, the masker sound may be unpleasant for the occupants, because the masker sound itself is a sound perceived as a noise by the occupants.

Figure 17:
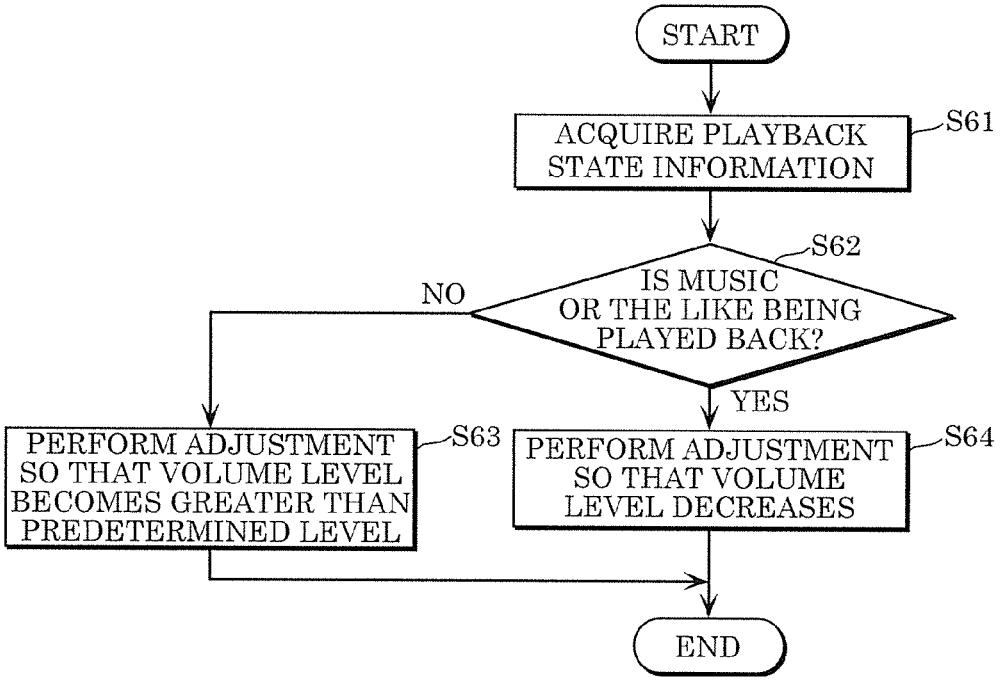
FIG. 17 is a flowchart illustrating Operation Example 3 of the noise masking device according to the embodiment.

In view of this, when it is determined that a sound is output from third speaker 53*c* (that is, music or the like is played back), adjustment unit 17 can adjust the volume level of the adjusted masker signal to a second level. FIG. 17 is a flowchart illustrating Operation Example 3.

In Operation Example 3, acquisition unit 11 acquires, from audio device 54, playback state information indicating whether music or the like is being played back by audio device 54, and outputs the playback state information to adjustment unit 17 (S61). The playback state information may be acquired through vehicle controller 52.

Adjustment unit 17 determines whether music or the like is being played back based on the acquired playback state information (S62). In other words, adjustment unit 17 determines whether a sound is output from third speaker 53*c* mounted in vehicle 50.

When adjustment unit 17 determines that music or the like is not being played back (No in S62), that is, no sound is output from third speaker 53*c*, adjustment unit 17 adjusts the pitch-shifted masker signal so that the volume level of the adjusted masker signal becomes greater than a predetermined level (S63).

On the other hand, when adjustment unit 17 determines that music or the like is being played back (Yes in S62), that is, a sound is output from third speaker 53*c*, adjustment unit 17 adjusts the pitch-shifted masker signal so that the volume level of the adjusted masker signal decreases (S64).

As described above, adjustment unit 17 may adjust the pitch-shifted masker signal so that the volume level of the adjusted masker signal decreases when music or the like is being played back. In this way, noise masking device 10 can adjust the pitch-shifted masker signal in consideration of whether music or the like is being played back in vehicle 50.

As described above, in a situation where music or the like is being played back by audio device 54, and the target noise is less perceivable to the occupants even when noise masking device 10 does not output the masker sound, noise masking device 10 can reduce the volume level of the masker sound. Therefore, noise masking device 10 can reduce the unpleasantness felt by the users because of an unnecessary masker sound.

Figure 18:
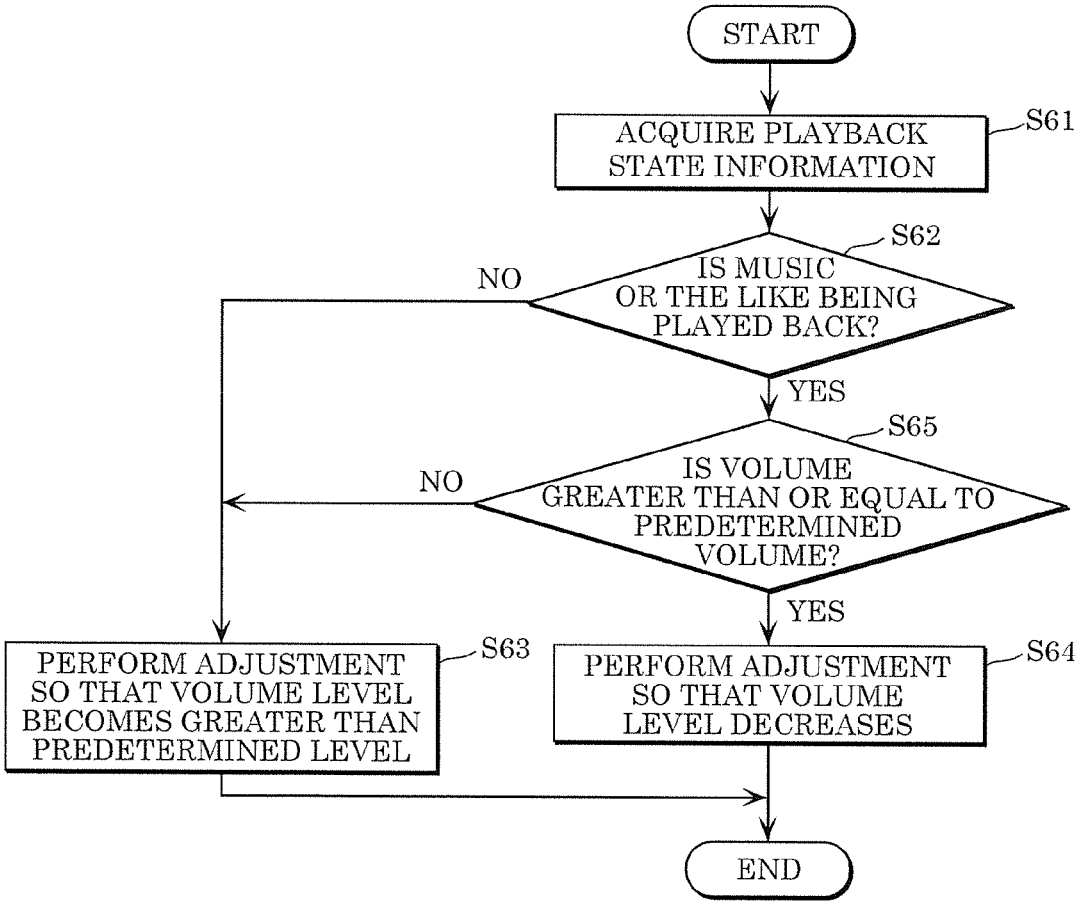
FIG. 18 is a flowchart illustrating a modification of Operation Example 3 of the noise masking device according to the embodiment.

Adjustment unit 17 may further determine whether the volume of the music being played back is greater than or equal to a predetermined volume. FIG. 18 is a flowchart illustrating such a modification of Operation Example 3.

In the modification of Operation Example 3, the playback state information acquired in step S61 includes volume information about the music or the like being played back.

After determining that music or the like is being played back (Yes in S61), adjustment unit 17 further determines whether the volume of the music or the like being played back is greater than or equal to a predetermined volume (S65). That is, adjustment unit 17 determines whether the volume of the sound being output from third speaker 53*c* is greater than or equal to the predetermined volume.

When adjustment unit 17 determines that the volume of the music or the like is lower than the predetermined volume (No in S65), that is, the volume of the sound being output from third speaker 53*c* is smaller than the predetermined volume, adjustment unit 17 adjusts the pitch-shifted masker signal so that the volume level of the adjusted masker signal becomes greater than a predetermined level (S63).

On the other hand, when adjustment unit 17 determines that the volume of the music or the like is greater than or equal to the predetermined volume (Yes in S65), that is, the volume of the sound being output from third speaker 53*c* is smaller than the predetermined volume, adjustment unit 17 adjusts the pitch-shifted masker signal so that the volume level of the adjusted masker signal decreases (S64).

As described above, adjustment unit 17 can adjust the pitch-shifted masker signal so that the volume level of the adjusted masker signal decreases when music or the like is being played back with a volume greater than or equal to a predetermined volume. Therefore, noise masking device 10 can reduce the volume level of the masker sound when the target noise does not need to be masked. Therefore, noise masking device 10 can reduce the unpleasantness felt by the users because of an unnecessary masker sound.

The predetermined volume used as a threshold for determination by adjustment unit 17 may be different between when music is not being played back and when music is being played back. That is, adjustment unit 17 may perform both steps S62 and S65, and may modify the threshold for the determination in step S65 in response to the result of determination in step S62 and make the determination in step S65 based on the modified threshold.

Operation Example 4

Operation Example 4 of noise masking device 10 will be described below. In space 56 in vehicle 50, air conditioning may be performed by air conditioner 57. While air conditioning is being performed by air conditioner 57, air conditioner 57 is blowing air into space 56 in vehicle 50, so that the target noise is less perceptible to the occupants even when noise masking device 10 does not output the masker sound.

Figure 19:
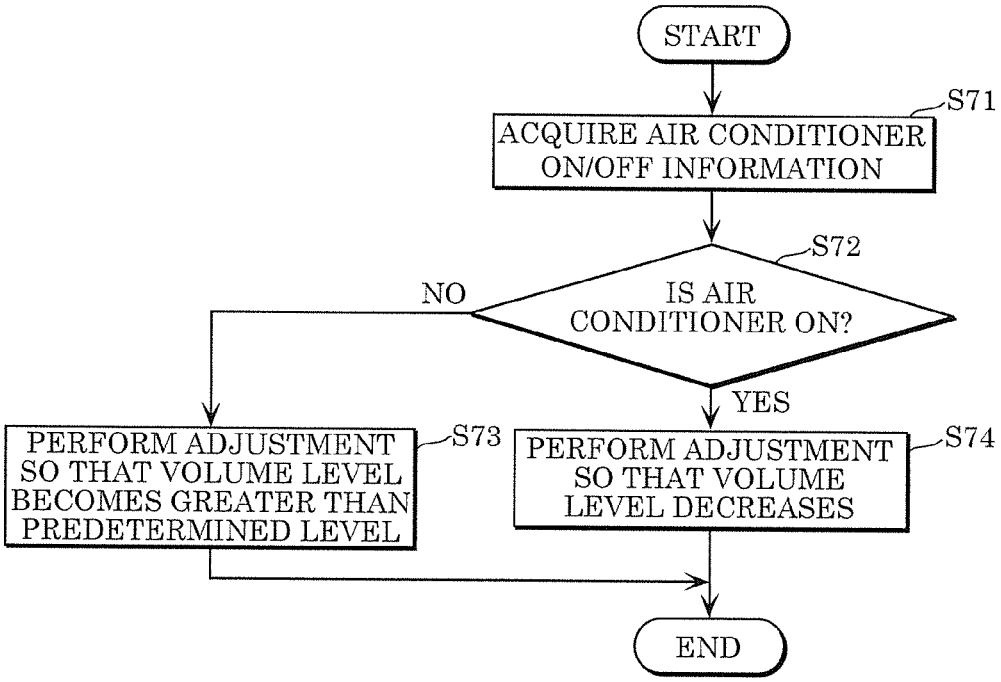
FIG. 19 is a flowchart illustrating Operation Example 4 of the noise masking device according to the embodiment.

In view of this, when air conditioner 57 is in the on state, adjustment unit 17 can adjust the volume level of the adjusted masker signal to a second level. FIG. 19 is a flowchart illustrating Operation Example 4.

In Operation Example 4, acquisition unit 11 acquires, from air conditioner 57, air conditioner ON/OFF information indicating whether air conditioner 57 is in the ON state or in the OFF state, and outputs the air conditioner ON/OFF information to adjustment unit 17 (S71). The air conditioner ON/OFF information may be acquired through vehicle controller 52.

Adjustment unit 17 determines whether air conditioner 57 is in the air conditioning operation (that is, the ON state) based on the acquired air conditioner ON/OFF information (S72).

When adjustment unit 17 determines that air conditioner is not in the air conditioning operation (No in S72), that is, the air conditioner ON/OFF information indicates the OFF state, adjustment unit 17 adjusts the pitch-shifted masker signal so that the volume level of the adjusted masker signal becomes greater than a predetermined level (S73).

On the other hand, when adjustment unit 17 determines that air conditioner is in the air conditioning operation (Yes in S72), that is, the air conditioner ON/OFF information indicates the ON state, adjustment unit 17 adjusts the pitch-shifted masker signal so that the volume level of the adjusted masker signal decreases (S74).

As described above, adjustment unit 17 may adjust the pitch-shifted masker signal so that the volume level of the adjusted masker signal decreases when air conditioning is being performed. In this way, noise masking device 10 can adjust the pitch-shifted masker signal in consideration of whether air conditioning is being performed in vehicle 50.

As described above, in a situation where air conditioner 57 is blowing air, and the target noise is less perceivable to the occupants even when noise masking device 10 does not output the masker sound, noise masking device 10 can reduce the volume level of the masker sound. Therefore, noise masking device 10 can reduce the unpleasantness felt by the users because of an unnecessary masker sound.

Figure 20:
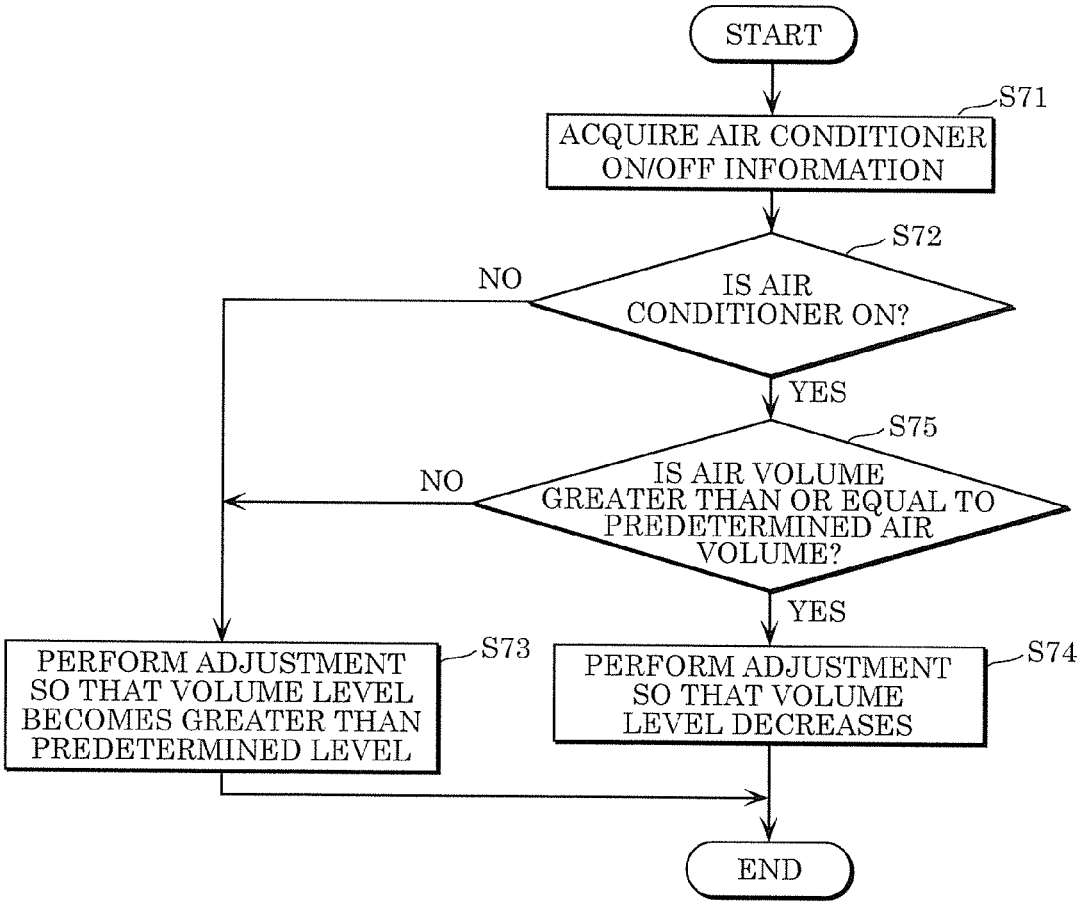
FIG. 20 is a flowchart illustrating a modification of Operation Example 4 of the noise masking device according to the embodiment.

Adjustment unit 17 may further determine whether the air volume during the air conditioning operation is greater than or equal to a predetermined air volume. FIG. 20 is a flowchart illustrating such a modification of Operation Example 4.

In the modification of Operation Example 4, the air conditioner ON/OFF information acquired in step S71 includes air volume information indicating the air volume of air conditioner 57.

After determining that air conditioning is being performed (Yes in S72), adjustment unit 17 further determines whether the air volume of air conditioner 57 is greater than or equal to a predetermined air volume (S75).

When adjustment unit 17 determines that the air volume of air conditioner 57 is lower than the predetermined volume (No in S75), adjustment unit 17 adjusts the pitch-shifted masker signal so that the volume level of the adjusted masker signal becomes greater than a predetermined level (S73).

On the other hand, when adjustment unit 17 determines that the air volume of air conditioner 57 is greater than or equal to the predetermined volume (Yes in S75), that is, the air volume information indicates an air volume greater than or equal to the predetermined air volume, adjustment unit 17 adjusts the pitch-shifted masker signal so that the volume level of the adjusted masker signal decreases (S74).

The predetermined volume used as a threshold for determination by adjustment unit 17 may be different between when the air conditioner is in the ON state and when the air conditioner is in the OFF state. That is, adjustment unit 17 may perform both steps S72 and S75, and may modify the threshold for the determination in step S75 in response to the result of determination in step S72 and make the determination in step S75 based on the modified threshold.

Operation Example 5

Operation Example 5 of noise masking device 10 will be described below. Window 58 of vehicle 50 may be opened, and outside air may flow into space 56 in vehicle 50. When outside air flows into space 56 in vehicle 50, wind noise occurs in space 56, so that the target noise is less perceptible to the occupants even when noise masking device 10 does not output the masker sound.

Figure 21:
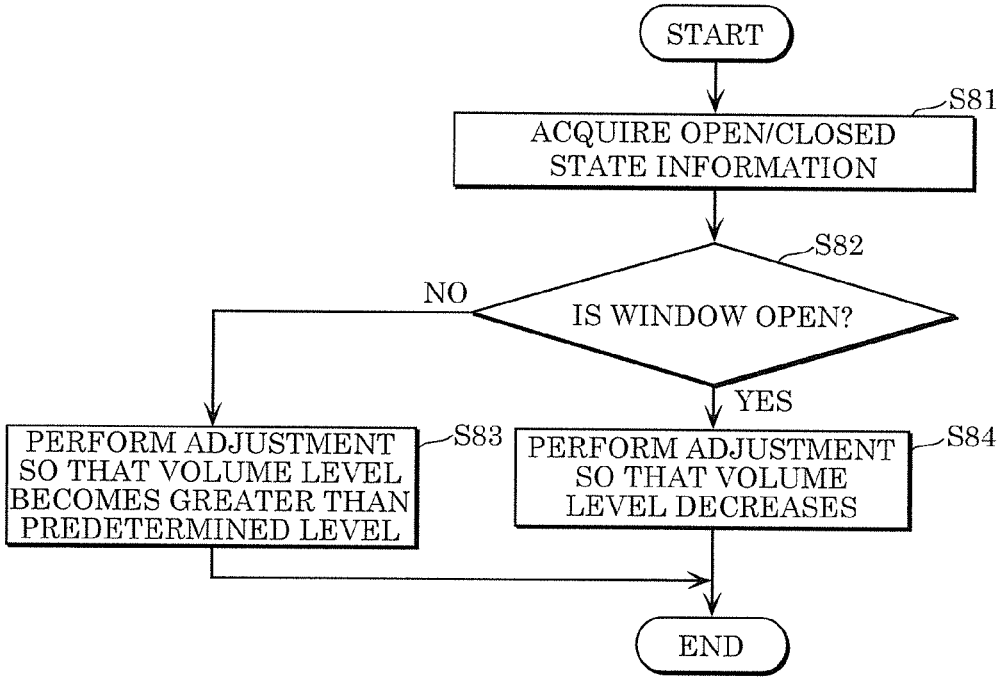
FIG. 21 is a flowchart illustrating Operation Example 5 of the noise masking device according to the embodiment.

In view of this, when window 58 is open, adjustment unit 17 can adjust the pitch-shifted masker signal so that the volume level of the adjusted masker signal decreases. FIG. 21 is a flowchart illustrating Operation Example 5.

In Operation Example 5, acquisition unit 11 acquires, from window 58, open/closed state information indicating whether window 58 is open or closed, and outputs the open/closed state information to adjustment unit 17 (S81). The open/closed state information may be acquired through vehicle controller 52.

Adjustment unit 17 determines whether window 58 is open based on the acquired open/closed state information (S82).

When adjustment unit 17 determines that window 58 is not open (No in S82), that is, the open/closed state information indicates the closed state, adjustment unit 17 adjusts the pitch-shifted masker signal so that the volume level of the adjusted masker signal becomes greater than a predetermined level (S83).

On the other hand, when adjustment unit 17 determines that window 58 is open (Yes in S82), that is, the open/closed state information indicates the open state, adjustment unit 17 adjusts the pitch-shifted masker signal so that the volume level of the adjusted masker signal decreases (S84).

As described above, adjustment unit 17 may adjust the pitch-shifted masker signal so that the volume level of the adjusted masker signal decreases when window 58 is open. In this way, noise masking device 10 can adjust the pitch-shifted masker signal in consideration of whether window 58 of vehicle 50 is open.

As described above, in a situation where window 58 of vehicle 50 is open, and the target noise is less perceivable to the occupants even when noise masking device 10 does not output the masker sound, noise masking device 10 can reduce the volume level of the masker sound. Therefore, noise masking device 10 can reduce the unpleasantness felt by the users because of an unnecessary masker sound.

Figure 22:
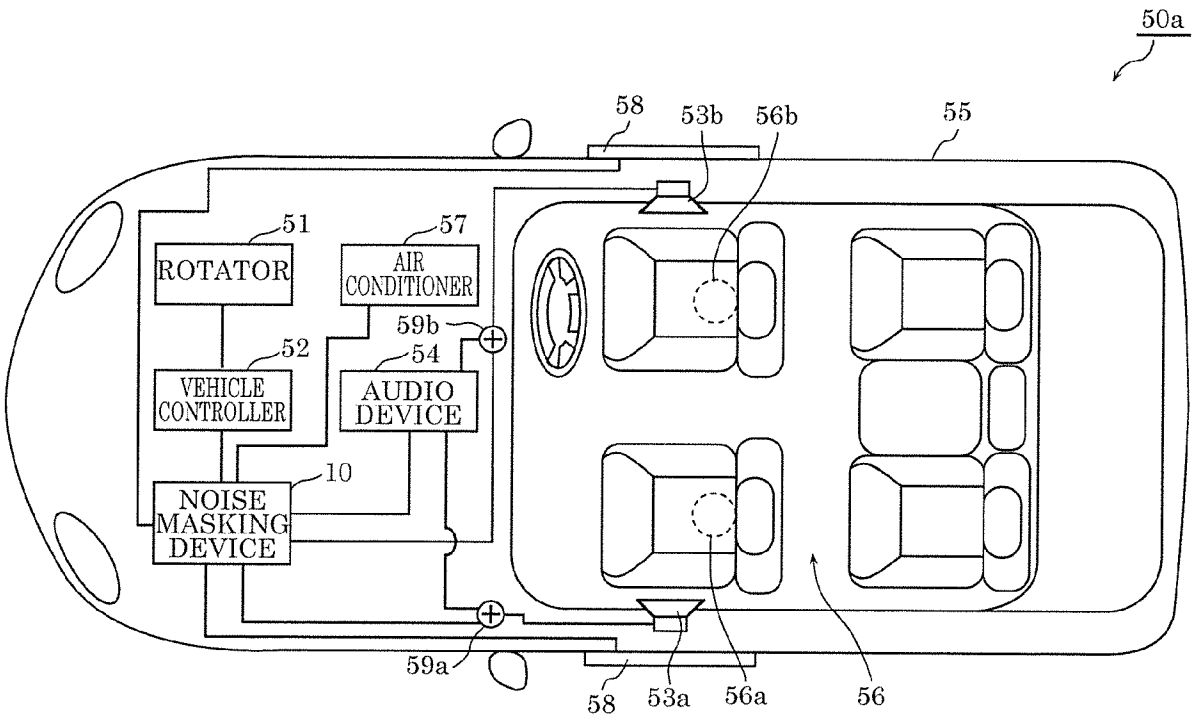
FIG. 22 is a schematic diagram showing a vehicle according to a modification.
Figure 23:
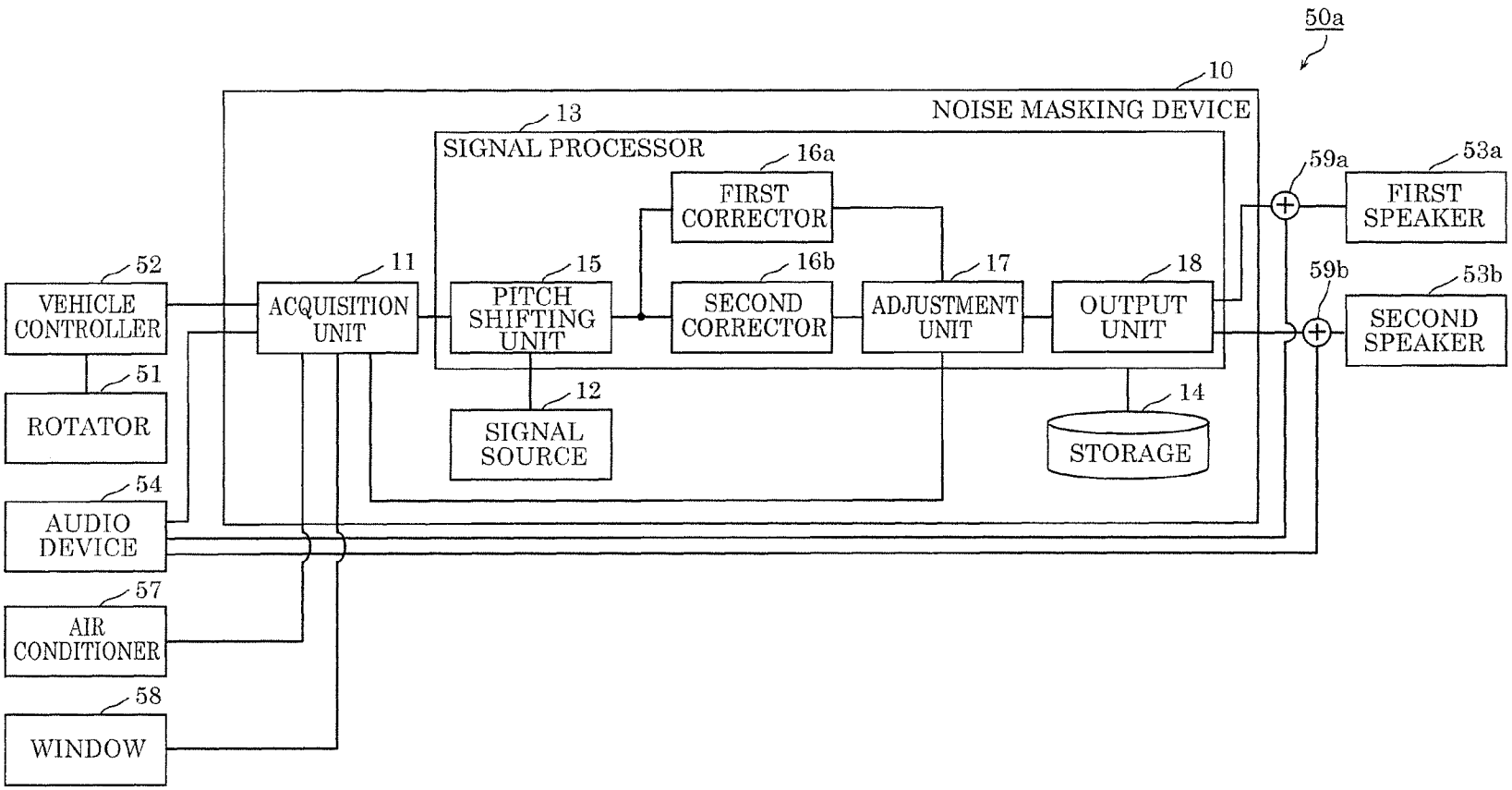
FIG. 23 is a functional block diagram showing the vehicle according to the modification.

In vehicle 50, the sound corresponding to the audio signal output from audio device 54 has been described as being output from third speaker 53*c*. However, the sound corresponding to the audio signal may be output from first speaker 53*a* and second speaker 53*b*. FIG. 22 is a schematic diagram illustrating a vehicle according to such a modification. FIG. 23 is a functional block diagram illustrating the vehicle according to the modification.

As illustrated in FIGS. 22 and 23, in vehicle 50*a* according to the modification, the sound corresponding to the audio signal output by audio device 54 and the masker sound corrected by first corrector 16*a* are added (mixed) by first adder 59*a*, and the resulting sound is output to first speaker 53*a*. Similarly, the sound corresponding to the audio signal output by audio device 54 and the masker sound corrected by second corrector 16*b* are added (mixed) by second adder 59*b*, and the resulting sound is output to second speaker 53*b*. First adder 59*a* and second adder 59*b* may be implemented as an analog circuit or a digital circuit.

Thus, a common speaker may be used both for playing back music or the like and for outputting the masker sound.

Other Exemplary Embodiments

Although an exemplary embodiment has been described above, the present disclosure is not limited to the foregoing exemplary embodiment.

Figure 24:
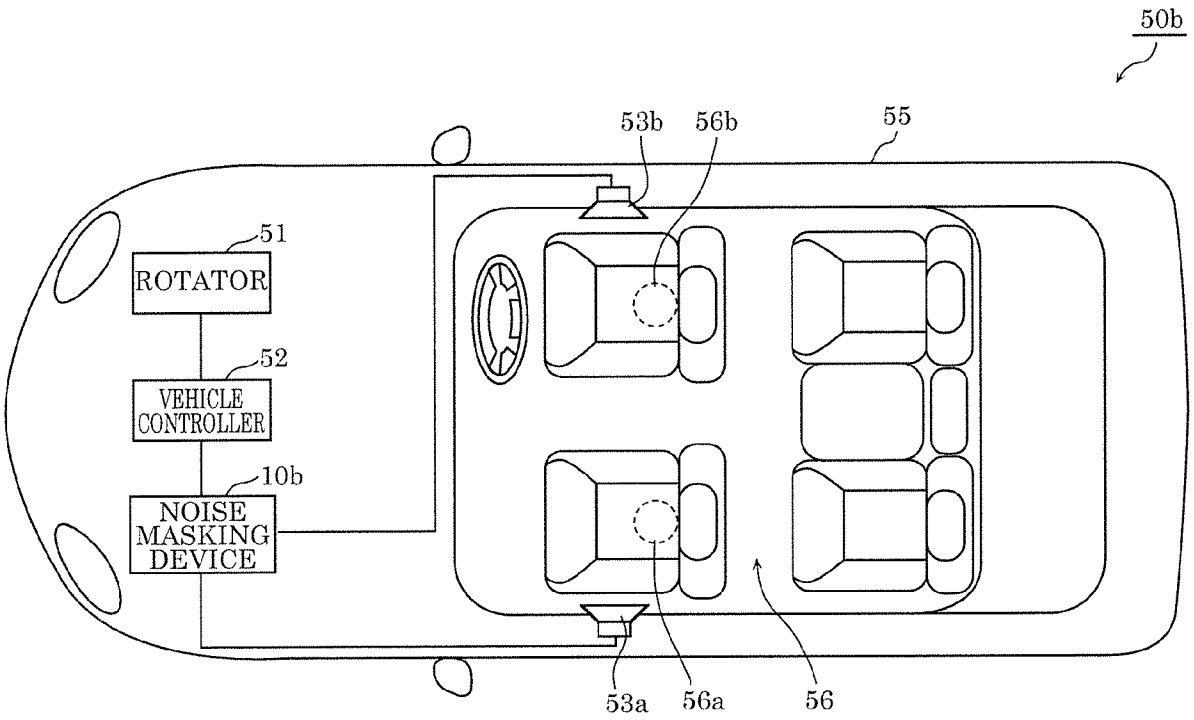
FIG. 24 is a schematic diagram showing a vehicle including a noise masking device according to another embodiment.
Figure 25:
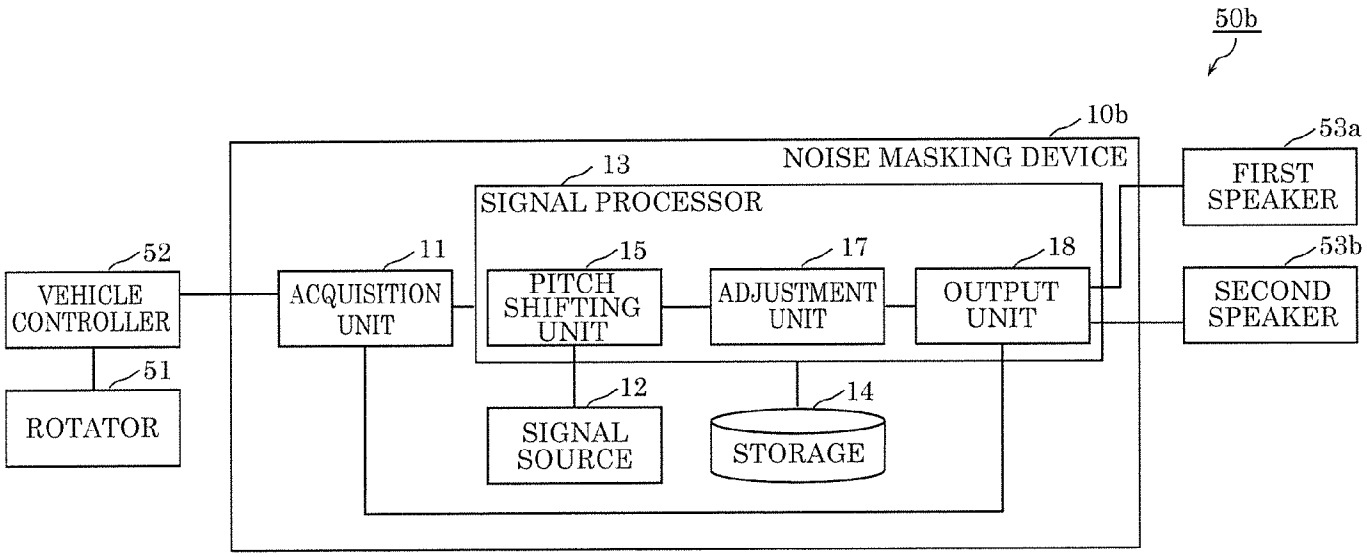
FIG. 25 is a functional block diagram showing the noise masking device according to the other embodiment.

For example, the noise masking device may have a simpler configuration than noise masking device 10 according to the exemplary embodiment described above. FIG. 24 is a schematic diagram illustrating a vehicle including a noise masking device having a simpler configuration. FIG. 25 is a functional block diagram illustrating the noise masking device having a simpler configuration.

As illustrated in FIG. 24, vehicle 50*b* including noise masking device 10*b* having a simpler configuration differs from noise masking device 10 in that vehicle 50*b* does not include third speaker 53*c*, first microphone 54*a*, second microphone 54*b*, audio device 54, air conditioner 57 and window 58. As illustrated in FIG. 25, noise masking device 10*b* further differs from noise masking device 10 in that noise masking device 10*b* does not include first corrector 16*a* and second corrector 16*b*.

As with noise masking device 10, noise masking device 10*b* can effectively mask a noise in a predetermined frequency band at the timing when the noise occurs, since noise masking device 10*b* adjusts the masker signal according to acceleration information about vehicle 50.

In the exemplary embodiment described above, two speakers output the masker sound. However, only one speaker may output the masker sound. Alternatively, three or more speakers may output the masker sound. For example, four speakers associated with four seats in the vehicle may be arranged.

In the exemplary embodiment described above, one predetermined position is set for a seat. However, a plurality of predetermined positions may be set for a seat. For example, two predetermined positions may be set at the ears of an occupant in a seat.

The configuration of the noise masking device according to the exemplary embodiment described above is just an example. For example, the noise masking device may include components such as a digital:analog (D/A) converter, a filter, a power amplifier, or an analog-digital (A/D) converter.

The processing performed by the noise masking device according to the exemplary embodiment described above is just an example. For example, various signal processing described in the above exemplary embodiment may be digital signal processing or analog signal processing.

The processing performed by the noise masking device according to the exemplary embodiment described above is just an example. In the exemplary embodiment described above, adjustment unit 17 adjusts the volume level of the adjusted masker signal to the first level or the second level. However, the present disclosure is not limited to the implementation. For example, in the exemplary embodiment described above, instead of adjusting the volume level of the adjusted masker signal to the second level, adjustment unit 17 may cause output unit 18 to stop outputting the adjusted masker signal to first speaker 53*a* and second speaker 53*b*.

In noise masking devices 10, 10*a*, and 10*b* according to the exemplary embodiment described above, acquisition unit 11 may acquire frequency-correlated information that is correlated to the frequency of the noise in vehicle 50. In that case, pitch shifting unit 15 generates the pitch-shifted masker signal by pitch-shifting the masker signal according to the frequency-correlated information acquired by acquisition unit 11.

Accordingly, noise masking devices 10, 10*a*, and 10*b* pitch-shift the masker signal generated by signal source 12 according to the acquired frequency-correlated information to generate a pitch-shifted masker signal, perform, on the pitch-shifted masker signal, an adjustment according to the acquired vehicle information to generate an adjusted masker signal, and output the adjusted masker signal as the masker sound. Therefore, noise masking devices 10, 10*a*, and 10*b* can effectively mask a noise in a predetermined frequency band at the timing when the noise occurs.

In noise masking devices 10, 10*a*, and 10*b* according to the exemplary embodiment described above, adjustment unit 17 generates the adjusted masker signal by adjusting the pitch-shifted masker signal according to the vehicle information acquired by acquisition unit 11. However, the present disclosure is not limited to this implementation. Adjustment unit 17 may generate the adjusted masker signal by calculating a time-varying value in the vehicle information acquired by acquisition unit 11 and adjusting the pitch-shifted masker signal according to the calculated time-varying value. That is, adjustment unit 17 may use time-varying value as a substitute for the vehicle information. In this case, each threshold used in the adjustment processing performed by adjustment unit 17 may be set at a different value in accordance with each time-varying value.

Accordingly, noise masking devices 10, 10*a*, and 10*b* perform, on the pitch-shifted masker signal, an adjustment according to the time-varying value in the acquired vehicle information to generate an adjusted masker signal, and output the adjusted masker signal as the masker sound from the output unit. Therefore, noise masking devices 10, 10*a*, and 10*b* can effectively mask a noise in a predetermined frequency band at the timing when the noise occurs.

Alternatively, adjustment unit 17 may generate the adjusted masker signal by performing at least one of a first adjustment and a second adjustment on the pitch-shifted masker signal. The first adjustment is to adjust the pitch-shifted masker signal according to the vehicle information. The second adjustment is to calculate a time-varying value in the vehicle information acquired by acquisition unit 11 and adjust the pitch-shifted masker signal according to the calculated time-varying value. That is, adjustment unit 17 may perform an adjustment using both the vehicle information and the time-varying value or an adjustment using any one of the vehicle information and the time-varying value.

Accordingly, noise masking devices 10, 10*a*, and 10*b* perform, on the pitch-shifted masker signal, an adjustment according to the acquired vehicle information and/or the time-varying value in the vehicle information to generate an adjusted masker signal, and output the adjusted masker signal as the masker sound from the output unit. Therefore, noise masking devices 10, 10*a*, and 10*b* can effectively mask a noise in a predetermined frequency band at the timing when the noise occurs.

In noise masking devices 10, 10*a*, and 10*b* according to the exemplary embodiment described above, adjustment unit 17 may determine whether the vehicle speed included in the vehicle information acquired by acquisition unit 11 is zero. And when the vehicle speed is zero, adjustment unit 17 may adjust the volume level of the pitch-shifted masker signal to zero or a low level that causes no hearing discomfort regardless of the magnitude of the vehicle information other than the vehicle speed and/or the time-varying value in the vehicle information.

Accordingly, noise masking devices 10, 10*a*, and 10*b* adjust the pitch-shifted masker signal so that the volume level of the masker signal becomes zero when the vehicle speed is zero and a noise in a predetermined frequency band is less likely to occur. Therefore, noise masking devices 10, 10*a*, and 10*b* can reduce the volume level of the masker signal to zero at the timing when the noise in the predetermined frequency band is less likely to occur. Therefore, noise masking devices 10, 10*a*, and 10*b* can reduce the unpleasantness felt by a user caused by the output of an unnecessary masker sound.

In noise masking devices 10, 10*a*, and 10*b* according to the exemplary embodiment described above, storage 14 may store a table that associates values of a plurality of vehicle information and/or the absolute values of a plurality of time-varying values included in the vehicle information with the respective volume levels. That is, the table may be a first table that associates a plurality of vehicle information having different values with a plurality of different volume levels having different values that correspond to the plurality of vehicle information. Alternatively, the table may be a second table that associates absolute values of a plurality of different time-varying values with a plurality of different volume levels having different values that correspond to the absolute values. The table may include both the first table and the second table.

Furthermore, adjustment unit 17 may read a volume level with which the vehicle information acquired by acquisition unit 11 and/or the absolute value calculated from the vehicle information are associated in the table stored in storage 14, and adjust the pitch-shifted masker signal so that a volume level of the adjusted masker signal becomes the volume level read. Accordingly, it is possible to output a masker sound at a volume level that is appropriate for the occurring noise level.

Furthermore, when vehicle information and/or an absolute value not included in the table stored in storage 14 is acquired, adjustment unit 17 may calculate an interpolation level corresponding to the vehicle information and/or the absolute value not included in the table from the plurality of vehicle information and/or the plurality of absolute values and the plurality of volume levels, which are associated with each other in the table, and adjust the pitch-shifted masker signal so that a volume level of the adjusted masker signal becomes the interpolation level calculated. Accordingly, it is possible to output a masker sound at a volume level that is more appropriate for the occurring noise level.

Specifically, when vehicle information and/or an absolute value that are not included in the table is acquired, adjustment unit 17 may extract, from the table, two values that are closest to the vehicle information and/or the absolute value that are not included in the table, and calculate an intermediate value between the two volume levels associated with the two values as an interpolation level. The interpolation level may be an average value of the two volume levels, or may be a volume level that corresponds to the vehicle information and/or the absolute value that are not included in the table on an approximate curve determined for two parameters shown in the table. The extracted two values are the value that is closest to the vehicle information and/or the absolute value that are not included in the table among the values that are greater than the vehicle information and/or the absolute value and the value that is closest to the vehicle information and/or the absolute value that are not included in the table among the values that are smaller than the vehicle information and/or the absolute value.

Furthermore, in the foregoing embodiment, each component may be configured by dedicated hardware or may be realized by execution of a software program suitable for each component. Each component may be realized by the readout and execution of a software program recorded in a recording medium such as a hard disk or a semiconductor memory by a program executing unit such as a CPU or a processor.

Furthermore, each component may be a circuit (or an integrated circuit). The circuits may constitute a single circuit as a whole, or may be individual circuits. Furthermore, each of the circuits may be a general-purpose circuit or may be a dedicated circuit.

Furthermore, an overall or specific aspect of the present disclosure may be realized by a system, a device, a method, an integrated circuit, a computer program, or a computer-readable non-transitory recording medium such as a CD-ROM. Furthermore, an overall or specific aspect of the present disclosure may also be realized by any combination of a system, a device, a method, an integrated circuit, a computer program, or a computer-readable non-transitory recording medium.

For example, the present disclosure may be realized as a noise masking method executed by a noise masking device (computer or DSP), or may be realized as a program for causing a computer or DSP to execute the noise reduction method described above.

Furthermore, in the foregoing embodiment, processes performed by a specific processing unit may be performed by another processing unit. Furthermore, the order of the plurality of processes in the operation of the noise masking device described in the foregoing embodiment may be changed, or the plurality of processes may be performed in parallel.

Aside from these, forms that can be obtained by various modifications to the respective embodiments that may be conceived by those skilled in the art, and forms realized by arbitrarily combining elements and functions in the respective embodiments without departing from the essence of the present disclosure are included in the present embodiment.

While various embodiments have been described herein above, it is to be appreciated that various changes in form and detail may be made without departing from the spirit and scope of the present disclosure presently or hereafter claimed.

FURTHER INFORMATION ABOUT TECHNICAL BACKGROUND TO THIS APPLICATION

The disclosures of the Japanese Patent Application including specification, drawings and claims are incorporated herein by references on their entirety: Japanese Patent Application No. 2017-213227 filed Nov. 2, 2017.

INDUSTRIAL APPLICABILITY

A noise masking device according to the present disclosure is useful as a device that masks noise in a cabin of a vehicle, for example.

The invention claimed is:

1. A noise masking device, comprising:

a memory that stores a program; and a processor that executes the program, wherein the processor, by executing the program stored in the memory:

acquires frequency information, the frequency information indicating a frequency of a noise in a vehicle, or frequency-correlated information correlated to the frequency;

acquires vehicle information relating to a characteristic of the noise;

generates a masker signal for outputting a masker sound that masks the noise in the vehicle;

pitch-shifts the masker signal according to the frequency information acquired, to generate a pitch-shifted masker signal;

adjusts the pitch-shifted masker signal according to the vehicle information acquired, to generate an adjusted masker signal, the pitch-shifted masker signal being adjusted so that a volume level of the adjusted masker signal changes over a transition time according to the vehicle information relating to the characteristic of the noise and/or a time-varying value in the vehicle information; and outputs the adjusted masker signal as the masker sound.

2. The noise masking device according to claim 1, wherein the vehicle includes a motor that drives the vehicle, and the processor performs, on the pitch-shifted masker signal, an adjustment according to information on the motor included in the vehicle information acquired.

3. The noise masking device according to claim 2, wherein the information on the motor is a number of rotations of the motor or a motor current value.

4. The noise masking device according to claim 1, wherein the vehicle includes an engine that drives the vehicle, and the processor performs, on the pitch-shifted masker signal, an adjustment according to information on the engine included in the vehicle information acquired.

5. The noise masking device according to claim 4, wherein the information on the engine is a number of rotations of the engine or an engine load.

6. The noise masking device according to claim 1, wherein the vehicle information is a vehicle speed, an accelerator pedal depression amount, a brake oil pressure, a number of rotations of a drive shaft, or a torque.

7. The noise masking device according to claim 1, wherein when a vehicle speed included in the vehicle information acquired is zero, the processor adjusts the pitch-shifted masker signal so that a volume level of the masker signal becomes zero or a low level that causes no hearing discomfort regardless of a magnitude of the vehicle information other than the vehicle speed and/or the time-varying value in the vehicle information.

8. The noise masking device according to claim 1, further comprising:

a storage that stores a table that associates values of a plurality of vehicle information with a plurality of volume levels, wherein the processor reads a volume level with the vehicle information acquired, and adjusts the pitch-shifted masker signal so that a volume level of the adjusted masker signal becomes the volume level read.

9. The noise masking device according to claim 8, wherein when vehicle information not included in the table is acquired, the processor calculates an interpolation level corresponding to the vehicle information not included in the table from the plurality of vehicle information and the plurality of volume levels, which are associated with each other in the table, and adjusts the pitch-shifted masker signal so that a volume level of the adjusted masker signal becomes the interpolation level calculated.

10. The noise masking device according to claim 1, wherein the processor:

further acquires air conditioner ON/OFF information indicating whether an air conditioner included in the vehicle is in an ON state or an OFF state; and adjusts the pitch-shifted masker signal so that a volume level of the adjusted masker signal decreases when the air conditioner ON/OFF information acquired indicates the ON state.

11. The noise masking device according to claim 1, wherein the processor:

further acquires air volume information indicating an air volume of an air conditioner included in the vehicle; and adjusts the pitch-shifted masker signal so that a volume level of the adjusted masker signal decreases when the air volume information acquired indicates an air volume greater than or equal to a predetermined air volume.

12. The noise masking device according to claim 1, wherein the processor:

further acquires playback state information indicating whether a sound is being played back by an audio device included in the vehicle;

determines whether a sound is being played back based on the playback state information acquired; and adjusts the pitch-shifted masker signal so that a volume level of the adjusted masker signal decreases when the sound is being played back.

13. The noise masking device according to claim 1, wherein the processor:

further acquires volume information about an audio device included in the vehicle;

determines whether the volume information acquired is greater than or equal to a predetermined volume; and adjusts the pitch-shifted masker signal so that a volume level of the adjusted masker signal decreases when the volume is greater than or equal to the predetermined volume.

14. The noise masking device according to claim 1, wherein the processor:

further acquires open/closed state information indicating whether a window of the vehicle is in an open state or a closed state; and adjusts the pitch-shifted masker signal so that a volume level of the adjusted masker signal decreases when the open/closed state information acquired indicates the open state.

15. The noise masking device according to claim 1, wherein the frequency-correlated information correlated to the frequency of the noise is a real number multiple of a vehicle speed, a real number multiple of a number of rotations of a motor included in the vehicle, or a real number multiple of a number of rotations of an engine included in the vehicle.

16. A vehicle, comprising:

the noise masking device according to claim 1; and a speaker that plays back the masker sound according to the adjusted masker signal outputted.

17. A noise masking method performed by a processor by executing a program stored in a memory, the method comprising:

acquiring frequency information, the frequency information indicating a frequency of a noise in a vehicle, or frequency correlated information correlated to the frequency;

acquiring vehicle information relating to a characteristic of the noise;

outputting a masker signal for outputting a masker sound that masks the noise in the vehicle;

pitch-shifting the masker signal according to the frequency information acquired, to generate a pitch-shifted masker signal;

adjusting the pitch-shifted masker signal according to the vehicle information acquired, to generate an adjusted masker signal, the pitch-shifted masker signal being adjusted so that a volume level of the adjusted masker signal changes over a transition time according to the vehicle information relating to the characteristic of the noise and/or a time-varying value in the vehicle information; and outputting the adjusted masker signal as the masker sound.

18. A noise masking device, comprising:

a memory that stores a program; and a processor that executes the program, wherein the processor, by executing the program stored in the memory:

acquires frequency information, the frequency information indicating a frequency of a noise in a vehicle, or frequency-correlated information correlated to the frequency;

acquires vehicle information relating to a characteristic of the noise;

generates a masker signal for outputting a masker sound that masks the noise in the vehicle;

pitch-shifts the masker signal according to the frequency information acquired, to generate a pitch-shifted masker signal;

calculates a time-varying value in the vehicle information acquired;

adjusts the pitch-shifted masker signal according to the time-varying value, to generate an adjusted masker signal, the pitch-shifted masker signal being adjusted so that a volume level of the adjusted masker signal changes over a transition time according to the vehicle information relating to the characteristic of the noise and/or the time-varying value in the vehicle information; and outputs the adjusted masker signal as the masker sound.

* * * * *